US006461109B1

(12) United States Patent
Wedlake et al.

(10) Patent No.: US 6,461,109 B1
(45) Date of Patent: Oct. 8, 2002

(54) THIRD-STAGE TURBINE NOZZLE AIRFOIL

(75) Inventors: Raymond Allan Wedlake, Greenville, SC (US); Thanh Vo, Simpsonville, SC (US); Frederick James Brunner, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/903,874

(22) Filed: Jul. 13, 2001

(51) Int. Cl.[7] ..... F01D 5/14

(52) U.S. Cl. ..... 416/223 R; 416/DIG. 2; 415/192

(58) Field of Search ..... 415/192, 191, 415/193, 208.1, 208.2, 209.1; 416/223 R, 243, DIG. 2, DIG. 5

(56) References Cited

U.S. PATENT DOCUMENTS

| | | | |
|---|---|---|---|
| 5,267,834 | A | 12/1993 | Dinh et al. |
| 5,299,915 | A | 4/1994 | Dinh et al. |
| 5,980,209 | A | 11/1999 | Barry et al. |

OTHER PUBLICATIONS

U.S. patent application Ser. No. 09/779,226, Burdgick et al., filed Feb. 2001.

U.S. patent application Ser. No. 09/886,406, Pirolla et al., filed Jun. 2001.

U.S. patent application Ser. No. 09/892,911, Wang et al., filed Jun. 2001.

U.S. patent application Ser. No. 09/899,543, Frost et al., filed Jul. 2001.

U.S. patent application Ser. No. 09/901,594, By et al., filed Jul. 2001.

U.S. patent application Ser. No. 09/903,853, Bielek et al., filed Jul. 2001.

U.S. patent application Ser. No. 09/987,433, Xu et al., filed Nov. 2001.

*Primary Examiner*—Edward K. Look
*Assistant Examiner*—James M McAleenan
(74) *Attorney, Agent, or Firm*—Nixon & Vanderhye

(57) ABSTRACT

The third-stage nozzles have vanes comprising airfoil profiles substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at the radially innermost aerodynamic section of the airfoil and X and Y are coordinate values defining the airfoil profile at each distance Z. The X, Y and Z values may be scaled as a function of the same constant or number to provide a scaled-up or scaled-down airfoil section for each nozzle vane.

10 Claims, 4 Drawing Sheets

THIRD-STAGE TURBINE NOZZLE AIRFOIL

BACKGROUND OF THE INVENTION

The present invention relates to a turbine nozzle for a gas turbine stage and particularly relates to a third-stage turbine nozzle airfoil profile.

In recent years, advanced gas turbines have trended toward increasing firing temperatures and efforts to improve cooling of the various turbine components. In a particular gas turbine design of the assignee, a high output turbine that uses air cooling is undergoing development. It will be appreciated that the design and construction of the turbine buckets and nozzles require optimized aerodynamic efficiency, as well as aerodynamic and mechanical loading.

BRIEF SUMMARY OF THE INVENTION

In accordance with an embodiment of the present invention, there is provided a unique turbine nozzle airfoil profile for a turbine stage, preferably the third stage, which may be defined by a unique loci of points to achieve the necessary efficiency in loading requirements whereby improved turbine performance is obtained. It will be appreciated that the nominal profile given by the X, Y, Z coordinates of Table I, which follows, define this unique loci of points. The coordinates given in inches in Table I are for a cold, i.e., room-temperature profile for each cross-section of the nozzle vane. Each defined cross-section is joined smoothly with adjacent cross-sections to form the complete airfoil shape. It will also be appreciated that as the nozzle heats up in use, the profile of the nozzle vane will change as a result of stress and temperature. Thus, the cold or room-temperature profile is given by the X, Y and Z coordinates for manufacturing purposes. Because a manufactured nozzle airfoil profile may be different than the nominal airfoil profile given in the following table, a distance of ±0.100 inches from the nominal profile in a direction normal to any surface location along the nominal profile and which includes any coating, defines the profile envelope for this design. The design is robust to this variation without impairment of the mechanical and aerodynamic functions.

It will also be appreciated that the airfoil can be scaled-up or scaled-down geometrically for introduction into other similar turbine designs. Consequently, the X, Y and Z coordinates of the nominal airfoil profile given below are a function of the same constant or number. That is, the X, Y and Z coordinate values given in the Table may be multiplied or divided by the same constant or number to provide a scaled-up or scaled-down version of the nozzle airfoil profile, while retaining the airfoil section shape.

In a preferred embodiment according to the present invention, there is provided a turbine nozzle having a nozzle vane in the shape of an airfoil in an envelope within ±0.100 inches in a direction normal to any airfoil surface location wherein the airfoil has an uncoated nominal profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinate values defining the airfoil profile at each distance Z, the profiles at the Z distances being joined smoothly with one another to form the complete airfoil shape.

In a further preferred embodiment according to the present invention, there is provided a turbine nozzle having a nozzle vane in the shape of an airfoil having an uncoated nominal airfoil profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinate values defining the airfoil profile at each distance Z, the profiles at the z distances being joined smoothly with one another to form the complete airfoil profile, the X, Y and Z values being scaled as a function of the same constant or number to provide a scaled-up or scaled-down nozzle airfoil.

In a further preferred embodiment according to the present invention, there is provided a turbine comprising a turbine nozzle having a plurality of vanes, each of said vanes being in the shape of an airfoil in an envelope within ±0.100 inches in a direction normal to any nozzle airfoil surface location wherein the airfoil has an uncoated nominal profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinate values defining the airfoil profile at each distance Z, the profiles at the Z distances being joined smoothly with one another to form the complete airfoil shape.

In a further preferred embodiment according to the present invention, there is provided a turbine comprising a turbine nozzle having a plurality of vanes, each of said vanes being in the shape of an airfoil having an uncoated nominal airfoil profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at the radially innermost aerodynamic section of the airfoil and X and Y are coordinate values defining the airfoil profile at each distance Z, the profiles at the Z distances being joined smoothly with one another to form the complete airfoil shape, the X, Y and Z values being scaled as a function of the same constant or number to provide a scaled-up or scaled-down nozzle airfoil.

DETAILED DESCRIPTION OF THE INVENTION

Figure 1:
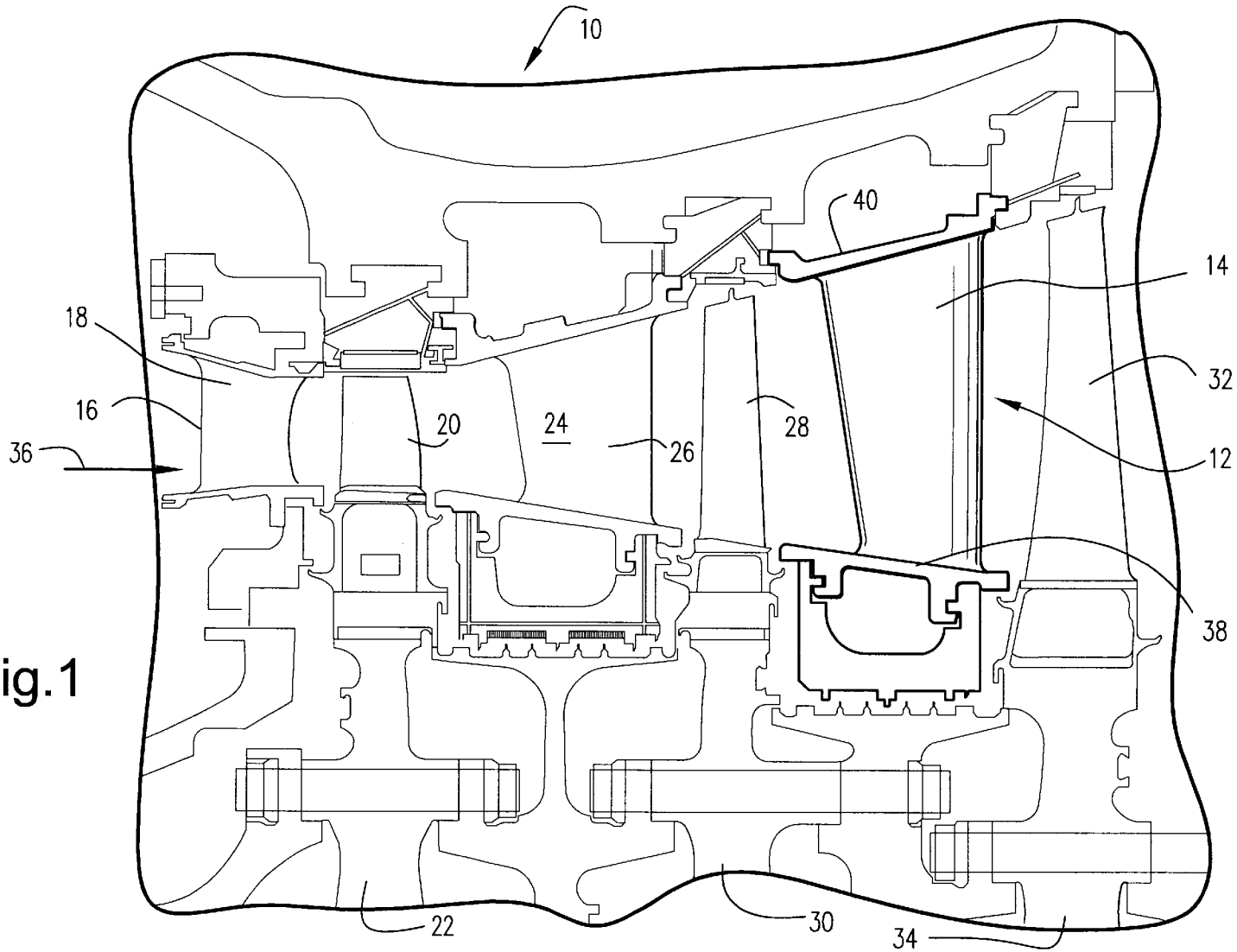
FIG. 1 is a schematic illustration of a turbine having a third-stage nozzle employing the airfoil or vane profile hereof.

Referring now to FIG. 1, there is illustrated a portion of a turbine, generally designated 10, having multiple stages including a third-stage, generally designated 12. Third-stage 12 includes a plurality of nozzles comprising vanes 14 having an airfoil shape or profile spaced circumferentially one from the other. The illustrated turbine 10 includes three stages, a first stage 16 having a plurality of circumferentially spaced nozzle vanes 18 and buckets 20 circumferentially spaced about a rotatable turbine wheel 22; a second stage 24 comprising a plurality of circumferentially spaced nozzle vanes 26 and a plurality of circumferentially spaced buckets 28 mounted on a second-stage wheel 30 and the third-stage 12 comprising a plurality of circumferentially spaced nozzle vanes 14 and a plurality of circumferentially spaced buckets 32 mounted on a third-stage wheel 34. It will be appreciated that the nozzle vanes and buckets lie in the hot gas path of the turbine and which gases flow through the turbine in the direction of the arrow 36. As illustrated, the nozzle vanes 14 of the third stage 12 are disposed between inner and outer bands 38 and 40, respectively, by which the nozzles form an annulus about the rotor axis.

Figure 2:
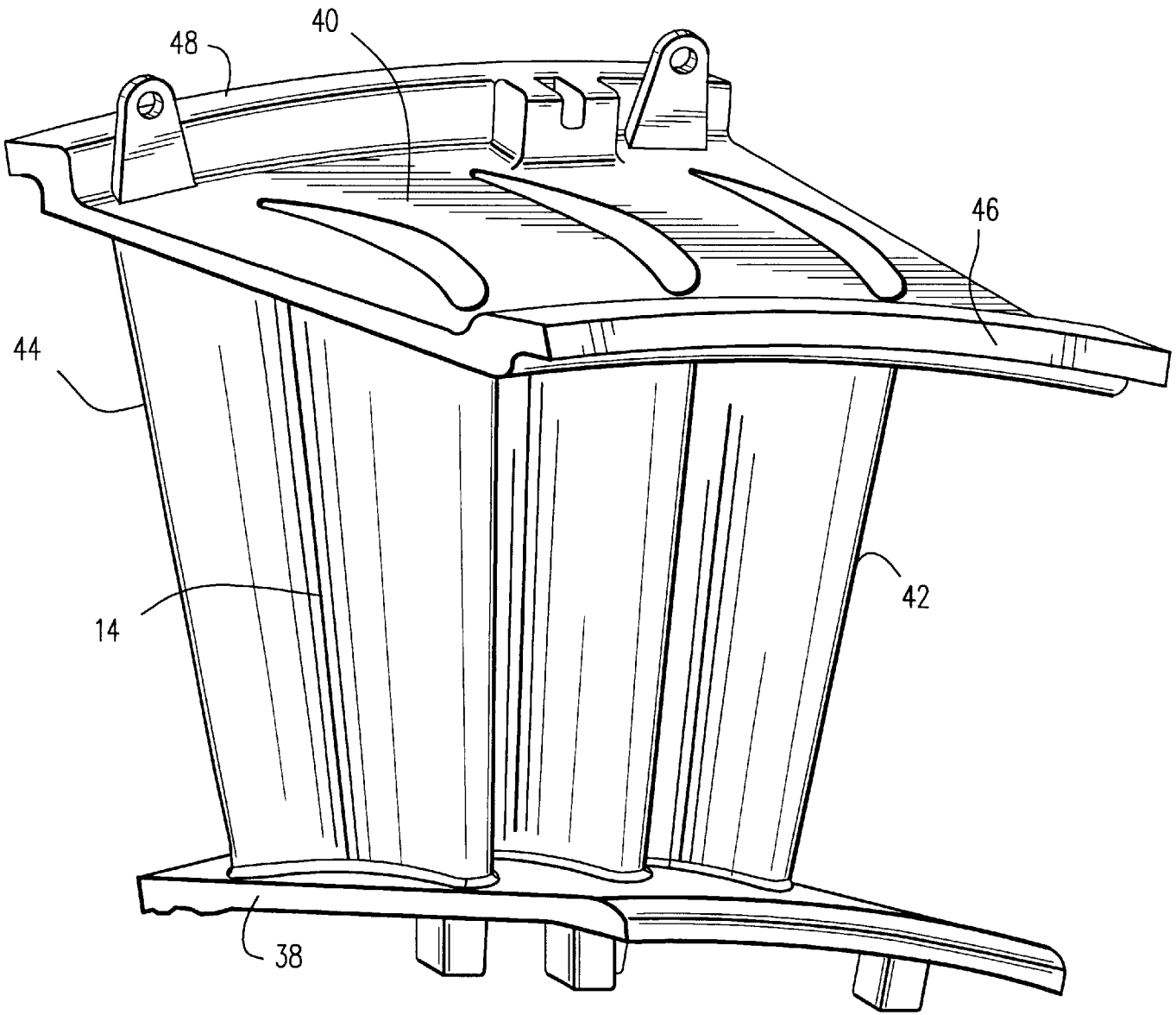
FIG. 2 is a perspective view of a nozzle segment illustrating the vanes thereof.

Referring to FIG. 2, the nozzle vanes 14 have leading and trailing edges 42 and 44, respectively, with hooks 46 and 48 for securing the nozzle vane segments to the non-rotatable casing of the turbine. As will be appreciated, the nozzle vanes have various passages therethrough for cooling the vanes. In the preferred and illustrated embodiment of the third-stage nozzle for this particular turbine, there are sixty nozzle vanes forming the third stage.

Referring now to drawing FIG. 2, there is illustrated a nozzle vane 14 for the third stage having airfoil profiles defined by a Cartesian coordinate system for X, Y and Z values. The coordinate values are set forth in inches in Table I which follows. The Cartesian coordinate system has orthogonally-related X, Y and Z axes with the Z axis extending perpendicular to a plane normal to a radius from the centerline of the turbine rotor, i.e., normal to a plane containing the X and Y values. The Z distance commences at zero in the X, Y plane at the radially innermost aerodynamic section. The X axis lies parallel to the turbine rotor centerline, i.e., the rotary axis. By defining X and Y coordinate values at selected locations in a Z direction normal to the X, Y plane, the profile of airfoil 14 can be ascertained. By connecting the X and Y values with smooth, continuing arcs, each profile section at each distance Z is fixed. The surface profiles at the various surface locations between the distances Z are connected smoothly to one another to form the airfoil. The tabular values given in Table I below are in inches and represent airfoil profiles at ambient, non-operating or non-hot conditions and are for an uncoated airfoil. The sign convention assigns a positive value to the value Z and positive and negative values for the X and Y coordinate values, as typically used in a Cartesian coordinate system.

The Table I values are generated and shown to four decimal places for determining the profiles of the airfoil. Where the values are carried out to less than four decimal places, zeros are added to the right to complete the value to four decimal places. Further, there are typical manufacturing tolerances as well as coatings which must be accounted for in the actual profile of the airfoil. Accordingly, the values for the profile given in Table I are for a nominal airfoil. It will therefore be appreciated that typical manufacturing tolerances, i.e., plus or minus values and coating thicknesses, are additive to the X and Y values given in Table I below. Accordingly, a distance of ±0.100 inches in a direction normal to any surface location along the airfoil profile defines an airfoil profile envelope for this particular nozzle vane design and turbine. In a preferred embodiment, the nozzle vane profiles given in Table I below are for the third stage of the turbine. Sixty nozzle vanes having such profiles are equally spaced from one another about the rotor axis and thus comprise the third stage.

The coordinate values given in Table I below in inches provide the preferred nominal profile envelope.

TABLE I

| X Coordinate | Y Coordinate | Z Coordinate |
|---|---|---|
| −5.3141 | 10.0979 | 18.1342 |
| −5.0139 | 9.5505 | 18.1342 |
| −6.7466 | 9.2005 | 18.1342 |
| −5.1074 | 10.0329 | 18.1342 |
| −5.2692 | 10.0963 | 18.1342 |
| −5.4679 | 10.092 | 18.1342 |
| −6.8847 | 8.6041 | 18.1342 |
| −5.9787 | 9.9584 | 18.1342 |
| −5.3404 | 10.0975 | 18.1342 |
| −5.0935 | 9.0127 | 18.1342 |
| −5.2816 | 10.0976 | 18.1342 |
| −4.9998 | 9.8073 | 18.1342 |
| −5.8385 | 10.0001 | 18.1342 |
| −5.195 | 10.0792 | 18.1342 |
| −6.8322 | 8.9151 | 18.1342 |
| −6.479 | 9.6519 | 18.1342 |
| −5.09 | 8.2923 | 18.1342 |
| −5.0383 | 9.3924 | 18.1342 |
| −5.5356 | 10.0809 | 18.1342 |
| −5.0585 | 9.9819 | 18.1342 |
| −5.2533 | 10.0949 | 18.1342 |
| −5.2763 | 10.0971 | 18.1342 |
| −5.7202 | 10.0366 | 18.1342 |
| −6.31 | 9.7995 | 18.1342 |
| −5.1092 | 8.7893 | 18.1342 |
| −5.0009 | 9.6884 | 18.1342 |
| −5.3732 | 10.0977 | 18.1342 |
| −5.1544 | 10.0622 | 18.1342 |
| −5.2763 | 10.0971 | 18.1342 |
| −6.6276 | 9.4501 | 18.1342 |
| −5.0489 | 8.0288 | 15.1342 |
| −5.2936 | 10.099 | 18.1342 |
| −5.0657 | 9.2134 | 18.1342 |
| −5.6196 | 10.0638 | 18.1342 |
| −5.4147 | 10.0976 | 18.1342 |
| −5.0181 | 9.9071 | 18.1342 |
| −5.2271 | 10.0894 | 18.1342 |
| −6.9111 | 8.2769 | 18.1342 |
| −6.1383 | 9.8972 | 18.1342 |
| −5.1094 | 8.5475 | 18.1342 |
| −6.7764 | 6.8429 | 18.1342 |
| −4.9856 | 7.7589 | 18.1342 |
| −6.8502 | 7.2166 | 18.1342 |
| −4.675 | 6.9198 | 18.1342 |
| −4.3907 | 6.3509 | 18.1342 |
| −6.8942 | 7.5816 | 18.1342 |
| −4.9012 | 7.4836 | 18.1342 |
| −6.5218 | 6.1025 | 18.1342 |
| −6.9134 | 7.9355 | 18.1342 |
| −4.5382 | 6.6347 | 18.1342 |
| −4.236 | 6.071 | 18.1342 |
| −6.6679 | 6.4686 | 18.1342 |
| −4.7973 | 7.2037 | 13.1342 |
| −3.1955 | 4.4604 | 18.1342 |
| −4.0756 | 5.7945 | 18.1342 |
| −4.3751 | 3.8528 | 18.1342 |
| −5.6097 | 4.8269 | 18.1342 |
| −2.5934 | 3.7185 | 18.1342 |
| −3.5639 | 4.9832 | 18.1342 |
| −4.7007 | 4.0742 | 18.1342 |
| −5.8791 | 5.1145 | 18.1342 |
| −3.0015 | 4.2062 | 18.1342 |
| −3.9099 | 5.521 | 18.1342 |
| −5.0168 | 4.309 | 18.1342 |
| −6.1237 | 5.4233 | 18.1342 |
| −5.3209 | 4.5592 | 18.1342 |
| −3.3827 | 4.7197 | 18.1342 |
| −6.3394 | 5.753 | 18.1342 |
| −2.8002 | 3.9578 | 18.1342 |
| −3.7394 | 5.2504 | 18.1342 |
| −3.7085 | 3.4421 | 18.1342 |

TABLE I-continued

| X Coordinate | Y Coordinate | Z Coordinate |
|---|---|---|
| −0.0411 | 1.6954 | 18.1342 |
| −0.4628 | 1.7853 | 18.1342 |
| −0.4094 | 1.9153 | 18.1342 |
| −0.1781 | 1.6542 | 18.1342 |
| −1.161 | 2.4207 | 18.1342 |
| 0.0274 | 1.5822 | 18.1342 |
| −2.174 | 3.279 | 18.1342 |
| −0.9282 | 2.0021 | 18.1342 |
| −2.7438 | 2.9088 | 18.1342 |
| 0.0454 | 1.6382 | 18.1342 |
| −0.1493 | 1.7585 | 18.1342 |
| −0.6612 | 2.0753 | 18.1342 |
| −0.0673 | 1.6033 | 18.1342 |
| −1.5543 | 2.725 | 18.1342 |
| −1.6023 | 2.3263 | 18.1342 |
| 0.041 | 1.5994 | 18.1342 |
| −1.8688 | 2.4584 | 18.1342 |
| −3.3779 | 3.2536 | 18.1342 |
| −0.004 | 1.673 | 18.1342 |
| −0.5954 | 1.8465 | 18.1342 |
| −0.3081 | 1.8535 | 18.1342 |
| −0.2559 | 1.69 | 18.1342 |
| −0.9791 | 2.2902 | 18.1342 |
| 0.0012 | 1.5727 | 18.1342 |
| −1.9652 | 3.0809 | 18.1342 |
| −1.1298 | 2.0976 | 18.1342 |
| −2.4417 | 2.7504 | 18.1342 |
| 0.0477 | 1.6159 | 18.1342 |
| −4.0426 | 3.6419 | 18.1342 |
| −0.0894 | 1.7232 | 18.1342 |
| −0.5268 | 1.9888 | 18.1342 |
| −0.1159 | 1.6254 | 18.1342 |
| −1.3541 | 2.5659 | 18.1342 |
| 0.0378 | 1.5937 | 18.1342 |
| −2.3837 | 3.4914 | 18.1342 |
| −0.75 | 1.9185 | 18.1342 |
| −3.0562 | 3.076 | 18.1342 |
| 0.0261 | 1.6581 | 18.1342 |
| −0.2218 | 1.8018 | 18.1342 |
| −0.3502 | 1.7338 | 18.1342 |
| −0.8122 | 2.1755 | 18.1342 |
| −0.0305 | 1.5858 | 18.1342 |
| −1.7585 | 2.8964 | 18.1342 |
| −1.3546 | 2.2056 | 18.1342 |
| −2.1499 | 2.6004 | 18.1342 |
| 0.0436 | 1.604 | 18.1342 |
| −5.052 | 9.1157 | 17.6211 |
| −5.0201 | 9.8027 | 17.6211 |
| −5.2174 | 9.9929 | 17.6211 |
| −5.3008 | 10.0057 | 17.6211 |
| −5.5171 | 9.9966 | 17.6211 |
| −6.1102 | 9.817 | 17.6211 |
| −5.0816 | 8.4569 | 17.6211 |
| −6.8039 | 8.8435 | 17.6211 |
| −5.011 | 9.4503 | 17.6211 |
| −5.1023 | 9.9308 | 17.6211 |
| −5.2586 | 10.0019 | 17.6211 |
| −5.3593 | 10.0078 | 17.6211 |
| −5.7002 | 9.9583 | 17.6211 |
| −6.4403 | 9.5681 | 17.6211 |
| −5.0732 | 8.9167 | 17.6211 |
| −6.8989 | 8.2146 | 17.6211 |
| −5.0029 | 9.7042 | 17.6211 |
| −5.1862 | 9.9815 | 17.6211 |
| −5.2813 | 10.0049 | 17.6211 |
| −5.4501 | 10.005 | 17.6211 |
| −5.9545 | 9.8826 | 17.6211 |
| −5.0615 | 8.2048 | 17.6211 |
| −6.7106 | 9.1272 | 17.6211 |
| −5.03 | 9.2934 | 17.6211 |
| −5.0567 | 9.8786 | 17.6211 |
| −5.243 | 9.9997 | 17.6211 |
| −5.3267 | 10.0065 | 17.6211 |
| −5.6003 | 9.982 | 17.6211 |
| −6.2764 | 9.7157 | 17.6211 |
| −5.0843 | 8.6957 | 17.6211 |
| −6.8651 | 8.5377 | 17.6211 |

TABLE I-continued

| X Coordinate | Y Coordinate | Z Coordinate |
|---|---|---|
| −5.0013 | 9.5868 | 17.6211 |
| −5.147 | 9.9629 | 17.6211 |
| −5.2656 | 10.0029 | 17.6211 |
| −5.2656 | 10.0029 | 17.6211 |
| −5.3982 | 10.0084 | 17.6211 |
| −5.2813 | 10.0049 | 17.6211 |
| −5.818 | 9.9257 | 17.6211 |
| −6.588 | 9.3707 | 17.6211 |
| −6.9075 | 7.8768 | 17.6211 |
| −6.5081 | 6.0631 | 17.6211 |
| −4.7862 | 7.1252 | 17.6211 |
| −6.8473 | 7.1651 | 17.6211 |
| −4.4023 | 6.2743 | 17.6211 |
| −4.9624 | 7.677 | 17.6211 |
| −6.6578 | 6.4231 | 17.6211 |
| −4.6715 | 6.8421 | 17.6211 |
| −6.8912 | 7.5263 | 17.6211 |
| −4.2542 | 5.9952 | 17.6211 |
| −4.5835 | 7.4037 | 17.6211 |
| −6.7712 | 6.796 | 17.6211 |
| −4.5424 | 6.5575 | 17.6211 |
| −5.022 | 7.9444 | 17.6211 |
| −3.2286 | 4.4027 | 17.6211 |
| −5.309 | 4.5434 | 17.6211 |
| −4.0992 | 5.7199 | 17.6211 |
| −6.1067 | 5.3958 | 17.6211 |
| −3.5964 | 4.9165 | 17.6211 |
| −4.6962 | 4.0614 | 17.6211 |
| −3.034 | 4.1538 | 17.6211 |
| −5.5951 | 4.8084 | 17.6211 |
| −3.9378 | 5.4483 | 17.6211 |
| −6.3234 | 5.7199 | 17.6211 |
| −3.416 | 4.6572 | 17.6211 |
| −5.0084 | 4.2951 | 17.6211 |
| −2.8316 | 3.9112 | 17.6211 |
| −5.8625 | 5.092 | 17.6211 |
| −3.7702 | 5.1804 | 17.6211 |
| −4.3749 | 3.8404 | 17.6211 |
| −1.1927 | 2.4126 | 17.6211 |
| −0.4969 | 1.7837 | 17.6211 |
| −2.203 | 3.2498 | 17.6211 |
| −0.1075 | 1.6047 | 17.6211 |
| 0.0006 | 1.6415 | 17.6211 |
| −3.7133 | 3.4276 | 17.6211 |
| −0.1913 | 1.761 | 17.6211 |
| −2.1719 | 2.5893 | 17.6211 |
| −0.6973 | 2.0737 | 17.6211 |
| −0.9566 | 1.9972 | 17.6211 |
| −1.5839 | 2.71 | 17.6211 |
| −0.2927 | 1.6898 | 17.6211 |
| −2.6238 | 3.6778 | 17.6211 |
| −0.0411 | 1.5802 | 17.6211 |
| −0.004 | 1.6031 | 17.6211 |
| −0.048 | 1.6762 | 17.6211 |
| −3.069 | 3.0619 | 17.6211 |
| −0.004 | 1.6031 | 17.6211 |
| −0.3481 | 1.8549 | 17.6211 |
| −1.6251 | 2.3169 | 17.6211 |
| −1.0122 | 2.2848 | 17.6211 |
| −0.6267 | 1.8435 | 17.6211 |
| −1.994 | 3.0569 | 17.6211 |
| −0.1547 | 1.6264 | 17.6211 |
| −0.004 | 1.6031 | 17.6211 |
| 0.0026 | 1.6194 | 17.6211 |
| −4.0468 | 3.6297 | 17.6211 |
| −0.1321 | 1.7259 | 17.6211 |
| −2.461 | 2.7379 | 17.6211 |
| −0.5643 | 1.9885 | 17.6211 |
| −1.1565 | 2.0915 | 17.6211 |
| −1.3846 | 2.5546 | 17.6211 |
| −0.3858 | 1.7328 | 17.6211 |
| −2.4132 | 3.4566 | 17.6211 |
| −0.0721 | 1.5885 | 17.6211 |
| −0.0182 | 1.6613 | 17.6211 |
| −3.3869 | 3.239 | 17.6211 |
| −0.2629 | 1.8038 | 17.6211 |
| −1.8932 | 2.4491 | 17.6211 |

TABLE I-continued

| X Coordinate | Y Coordinate | Z Coordinate |
|---|---|---|
| −0.8469 | 2.1722 | 17.6211 |
| −0.78 | 1.9146 | 17.6211 |
| −1.7875 | 2.8771 | 17.6211 |
| −0.216 | 1.6546 | 17.6211 |
| −0.0169 | 1.5888 | 17.6211 |
| −0.0014 | 1.6077 | 17.6211 |
| −0.0845 | 1.6984 | 17.6211 |
| −2.7601 | 2.8952 | 17.6211 |
| −0.4482 | 1.916 | 17.6211 |
| −1.3794 | 2.1979 | 17.6211 |
| −6.2049 | 9.4384 | 15.9099 |
| −6.8255 | 8.3099 | 15.9099 |
| −5.0022 | 8.6028 | 15.9099 |
| −5.009 | 9.3629 | 15.9099 |
| −5.235 | 9.69 | 15.9099 |
| −5.1592 | 9.6532 | 15.9099 |
| −5.3597 | 9.7172 | 15.9099 |
| −5.7736 | 9.6737 | 15.9099 |
| −6.5035 | 9.0969 | 15.9099 |
| −4.9966 | 8.9672 | 15.9099 |
| −5.0561 | 9.5323 | 15.9099 |
| −5.2649 | 9.6987 | 15.9099 |
| −5.2097 | 9.6806 | 15.9099 |
| −5.4768 | 9.7226 | 15.9099 |
| −6.0511 | 9.5492 | 15.9099 |
| −6.7424 | 8.6011 | 15.9099 |
| −4.9995 | 8.3902 | 15.9099 |
| −4.9985 | 9.2506 | 15.9099 |
| −5.2303 | 9.6883 | 15.9099 |
| −5.1265 | 9.6282 | 15.9099 |
| −5.3203 | 9.7112 | 15.9099 |
| −5.2303 | 9.6883 | 15.9099 |
| −5.658 | 9.7024 | 15.9099 |
| −6.3584 | 9.2881 | 15.9099 |
| −6.8808 | 7.9993 | 15.9099 |
| −5 | 8.7951 | 15.9099 |
| −5.0276 | 9.4567 | 15.9099 |
| −5.2458 | 9.6935 | 15.9099 |
| −5.1868 | 9.6697 | 15.9099 |
| −5.4109 | 9.7216 | 15.9099 |
| −5.9055 | 9.6252 | 15.9099 |
| −6.6338 | 8.8659 | 15.9099 |
| −4.9886 | 8.1609 | 15.9099 |
| −4.9951 | 9.119 | 15.9099 |
| −5.0905 | 9.5887 | 15.9099 |
| −5.2894 | 9.7047 | 15.9099 |
| −5.2239 | 9.6861 | 15.9099 |
| −5.559 | 9.7175 | 15.9099 |
| −4.8876 | 7.4087 | 15.9099 |
| −6.7751 | 6.6242 | 15.9099 |
| −4.6643 | 6.5886 | 15.9099 |
| −4.9672 | 7.9189 | 15.9099 |
| −6.9067 | 7.6722 | 15.9099 |
| −6.4904 | 5.9282 | 15.9099 |
| −4.8276 | 7.142 | 15.9099 |
| −6.8575 | 6.9809 | 15.9099 |
| −4.5612 | 6.3064 | 15.9099 |
| −4.9339 | 7.6679 | 15.9099 |
| −6.6519 | 6.2706 | 15.9099 |
| −4.7533 | 6.8684 | 15.9099 |
| −6.9001 | 7.3316 | 15.9099 |
| −4.4452 | 6.0257 | 15.9099 |
| −5.829 | 5.0088 | 15.9099 |
| −3.1371 | 3.9894 | 15.9099 |
| −4.3841 | 3.7951 | 15.9099 |
| −4.0306 | 5.2147 | 15.9099 |
| −5.2856 | 4.4829 | 15.9099 |
| −3.5227 | 4.4587 | 15.9099 |
| −4.3179 | 5.7499 | 15.9099 |
| −6.074 | 5.297 | 15.9099 |
| −2.9317 | 3.7656 | 15.9099 |
| −4.6931 | 4.013 | 15.9099 |
| −3.8713 | 4.9561 | 15.9099 |
| −5.5649 | 4.7379 | 15.9099 |
| −3.3343 | 4.2204 | 15.9099 |
| −4.1796 | 5.4794 | 15.9099 |
| −6.2961 | 5.6034 | 15.9099 |

TABLE I-continued

| X Coordinate | Y Coordinate | Z Coordinate |
|---|---|---|
| −4.9942 | 4.2418 | 15.9099 |
| −3.7018 | 4.704 | 15.9099 |
| −1.9927 | 2.4294 | 15.9099 |
| −0.4822 | 1.8599 | 15.9099 |
| −0.9144 | 1.9189 | 15.9099 |
| −1.1238 | 2.2682 | 15.9099 |
| −0.3644 | 1.6664 | 15.9099 |
| −2.0884 | 2.9835 | 15.9099 |
| −0.1668 | 1.5991 | 15.9099 |
| −0.1473 | 1.6312 | 15.9099 |
| −2.8333 | 2.8618 | 15.9099 |
| −0.2749 | 1.7353 | 15.9099 |
| −1.4967 | 2.191 | 15.9099 |
| −0.6903 | 1.9878 | 15.9099 |
| −0.6381 | 1.7917 | 15.9099 |
| −1.4869 | 2.5203 | 15.9099 |
| −0.2578 | 1.618 | 15.9099 |
| −2.5082 | 3.3493 | 15.9099 |
| −0.1537 | 1.6156 | 15.9099 |
| −3.752 | 3.3876 | 15.9099 |
| −0.166 | 1.6722 | 15.9099 |
| −2.2634 | 2.5645 | 15.9099 |
| −0.4003 | 1.8107 | 15.9099 |
| −1.0858 | 1.9986 | 15.9099 |
| −0.9634 | 2.1621 | 15.9099 |
| −0.4392 | 1.7006 | 15.9099 |
| −1.8834 | 2.8184 | 15.9099 |
| −0.1917 | 1.5895 | 15.9099 |
| −0.1512 | 1.62 | 15.9099 |
| −3.1316 | 3.0254 | 15.9099 |
| −0.2293 | 1.7085 | 15.9099 |
| −1.7357 | 2.3048 | 15.9099 |
| −0.5784 | 1.9185 | 15.9099 |
| −0.7656 | 1.8503 | 15.9099 |
| −1.2994 | 2.388 | 15.9099 |
| −0.3046 | 1.639 | 15.9099 |
| −2.2971 | 3.1601 | 15.9099 |
| −0.1568 | 1.6102 | 15.9099 |
| −4.0688 | 3.5863 | 15.9099 |
| −0.1487 | 1.6524 | 15.9099 |
| −2.5438 | 2.7081 | 15.9099 |
| −0.3316 | 1.7692 | 15.9099 |
| −1.28 | 2.0892 | 15.9099 |
| −0.8187 | 2.0689 | 15.9099 |
| −0.53 | 1.7423 | 15.9099 |
| −1.6825 | 2.6644 | 15.9099 |
| −0.2225 | 1.6009 | 15.9099 |
| −2.721 | 3.5516 | 15.9099 |
| −0.1537 | 1.6156 | 15.9099 |
| −3.438 | 3.2005 | 15.9099 |
| −0.1943 | 1.687 | 15.9099 |
| −5.4238 | 9.4637 | 14.1997 |
| −5.9705 | 9.2816 | 14.1997 |
| −6.6675 | 8.3738 | 14.1997 |
| −4.9338 | 8.1182 | 14.1997 |
| −4.9806 | 8.9451 | 14.1997 |
| −5.1956 | 9.388 | 14.1997 |
| −5.1087 | 9.312 | 14.1997 |
| −5.2761 | 9.4279 | 14.1997 |
| −5.1956 | 9.388 | 14.1997 |
| −5.6001 | 9.4528 | 14.1997 |
| −6.2602 | 9.0195 | 14.1997 |
| −4.9477 | 8.5078 | 14.1997 |
| −5.0225 | 9.141 | 14.1997 |
| −5.2092 | 9.3961 | 14.1997 |
| −5.1583 | 9.3619 | 14.1997 |
| −5.3606 | 9.4539 | 14.1997 |
| −5.8353 | 9.3654 | 14.1997 |
| −6.5439 | 8.6219 | 14.1997 |
| −4.9664 | 8.8191 | 14.1997 |
| −5.0791 | 9.2701 | 14.1997 |
| −5.248 | 9.416 | 14.1997 |
| −5.1901 | 9.3846 | 14.1997 |
| −5.5038 | 9.4653 | 14.1997 |
| −6.1136 | 9.1669 | 14.1997 |
| −6.7689 | 8.0984 | 14.1997 |
| −4.9411 | 8.3227 | 14.1997 |

TABLE I-continued

| X Coordinate | Y Coordinate | Z Coordinate |
|---|---|---|
| −4.9993 | 9.052 | 14.1997 |
| −5.1997 | 9.3906 | 14.1997 |
| −5.1353 | 9.3412 | 14.1997 |
| −5.3125 | 9.4409 | 14.1997 |
| −5.7111 | 9.4212 | 14.1997 |
| −6.4054 | 8.8381 | 14.1997 |
| −4.9557 | 8.6733 | 14.1997 |
| −5.0498 | 9.2135 | 14.1997 |
| −5.2261 | 9.4052 | 14.1997 |
| −5.1779 | 9.3766 | 14.1997 |
| −4.8064 | 6.9108 | 14.1997 |
| −6.8365 | 6.8156 | 14.1997 |
| −4.5864 | 6.0957 | 14.1997 |
| −4.8841 | 7.4215 | 14.1997 |
| −6.8413 | 7.8014 | 14.1997 |
| −6.6206 | 6.1327 | 14.1997 |
| −4.7484 | 6.6441 | 14.1997 |
| −4.9234 | 7.8975 | 14.4997 |
| −6.879 | 7.1554 | 14.1997 |
| −4.4823 | 5.8224 | 14.1997 |
| −4.851 | 7.1702 | 14.1997 |
| −6.7499 | 6.4717 | 14.1997 |
| −4.6753 | 6.371 | 14.1997 |
| −4.9075 | 7.6641 | 14.1997 |
| −6.8794 | 7.4856 | 14.1997 |
| −6.4536 | 5.8062 | 14.1997 |
| −4.3643 | 5.5547 | 14.1997 |
| −6.0341 | 5.2056 | 14.1997 |
| −3.0034 | 3.6658 | 14.1997 |
| −4.6891 | 3.9682 | 14.1997 |
| −3.9333 | 4.7912 | 14.1997 |
| −5.5335 | 4.6708 | 14.1997 |
| −3.4022 | 4.0935 | 14.1997 |
| −4.2331 | 5.2933 | 14.1997 |
| −6.2562 | 5.4971 | 14.1997 |
| −4.9797 | 4.1913 | 14.1997 |
| −3.7663 | 4.5511 | 14.1997 |
| −5.792 | 4.9305 | 14.1997 |
| −3.2067 | 3.876 | 14.1997 |
| −4.3913 | 3.755 | 14.1997 |
| −4.0892 | 5.0387 | 14.1997 |
| −5.2619 | 4.4249 | 14.1997 |
| −3.589 | 4.3186 | 14.1997 |
| −3.7825 | 3.3549 | 14.1997 |
| −0.3131 | 1.6837 | 14.1997 |
| −2.3445 | 2.5504 | 14.1997 |
| −0.5389 | 1.8168 | 14.1997 |
| −1.2047 | 2 | 14.1997 |
| −1.0826 | 2.1525 | 14.1997 |
| −0.5792 | 1.7096 | 14.1997 |
| −1.9749 | 2.7754 | 14.1997 |
| −0.3392 | 1.6025 | 14.1997 |
| −0.3005 | 1.6328 | 14.1997 |
| −3.1842 | 2.9995 | 14.1997 |
| −0.3741 | 1.7187 | 14.1997 |
| −1.8336 | 2.2981 | 14.1997 |
| −0.7108 | 1.92 | 14.1997 |
| −0.895 | 1.8554 | 14.1997 |
| −1.4078 | 2.3676 | 14.1997 |
| −0.4489 | 1.6496 | 14.1997 |
| −2.379 | 3.0972 | 14.1997 |
| −0.3059 | 1.6233 | 14.1997 |
| −4.0877 | 3.55 | 14.1997 |
| −0.2975 | 1.6638 | 14.1997 |
| −2.6159 | 2.6899 | 14.1997 |
| −0.4727 | 1.7771 | 14.1997 |
| −1.3926 | 2.0882 | 14.1997 |
| −0.9428 | 2.0636 | 14.1997 |
| −0.6671 | 1.7501 | 14.1997 |
| −1.7795 | 2.6297 | 14.1997 |
| −0.3695 | 1.6124 | 14.1997 |
| −2.7954 | 3.4648 | 14.1997 |
| −0.3029 | 1.6285 | 14.1997 |
| −3.4798 | 3.1711 | 14.1997 |
| −0.3403 | 1.6983 | 14.1997 |
| −2.0825 | 2.4192 | 14.1997 |
| −0.6179 | 1.8639 | 14.1997 |

TABLE I-continued

| X Coordinate | Y Coordinate | Z Coordinate |
|---|---|---|
| −1.0389 | 1.9224 | 14.1997 |
| −1.2378 | 2.2536 | 14.1997 |
| −0.5068 | 1.6764 | 14.1997 |
| −2.1748 | 2.931 | 14.1997 |
| −0.3155 | 1.6124 | 14.1997 |
| −0.2966 | 1.6435 | 14.1997 |
| −2.8959 | 2.8396 | 14.1997 |
| −0.418 | 1.7445 | 14.1997 |
| −1.6024 | 2.1873 | 14.1997 |
| −0.8188 | 1.9862 | 14.1997 |
| −0.7717 | 1.7983 | 14.1997 |
| −1.5895 | 2.4932 | 14.1997 |
| −0.4035 | 1.6294 | 14.1997 |
| −2.586 | 3.275 | 14.1997 |
| −0.3029 | 1.6285 | 14.1997 |
| −5.1746 | 9.1661 | 12.4885 |
| −5.1221 | 9.1381 | 12.4885 |
| −5.325 | 9.2073 | 12.4885 |
| −5.7747 | 9.0844 | 12.4885 |
| −6.4543 | 8.3629 | 12.4885 |
| −4.9176 | 8.6257 | 12.4885 |
| −5.0343 | 9.0593 | 12.4885 |
| −5.2137 | 9.1813 | 12.4885 |
| −5.155 | 9.1568 | 12.4885 |
| −5.4632 | 9.204 | 12.4885 |
| −6.037 | 8.8855 | 12.4885 |
| −4.9191 | 8.1425 | 12.4885 |
| −4.9442 | 8.8528 | 12.4885 |
| −5.165 | 9.1616 | 12.4885 |
| −5.0975 | 9.1206 | 12.4885 |
| −5.2776 | 9.2001 | 12.4885 |
| −5.6586 | 9.1449 | 12.4885 |
| −6.318 | 8.5691 | 12.4885 |
| −4.9145 | 8.4836 | 12.4885 |
| −4.9999 | 9.0076 | 12.4885 |
| −5.1916 | 9.1732 | 12.4885 |
| −5.1423 | 9.1504 | 12.4885 |
| −5.3865 | 9.2104 | 12.4885 |
| −5.9016 | 8.9988 | 12.4885 |
| −6.5778 | 8.1263 | 12.4885 |
| −4.922 | 7.9435 | 12.4885 |
| −4.927 | 8.7486 | 12.4885 |
| −5.1607 | 9.1596 | 12.4885 |
| −5.068 | 9.096 | 12.4885 |
| −5.2416 | 9.1907 | 12.4885 |
| −5.1607 | 9.1596 | 12.4885 |
| −5.5545 | 9.1836 | 12.4885 |
| −6.1773 | 8.7428 | 12.4885 |
| −4.9158 | 8.3225 | 12.4885 |
| −4.9689 | 8.9388 | 12.4885 |
| −4.7801 | 6.5069 | 12.4885 |
| −4.9212 | 7.7287 | 12.4885 |
| −6.8002 | 6.9571 | 12.4885 |
| −4.8721 | 7.02 | 12.4885 |
| −6.6807 | 7.8632 | 12.4885 |
| −6.6757 | 6.2988 | 12.4885 |
| −4.7114 | 6.2408 | 12.4885 |
| −4.9141 | 7.5014 | 12.4885 |
| −6.7973 | 7.2751 | 12.4885 |
| −4.8332 | 6.767 | 12.4885 |
| −6.7603 | 6.6297 | 12.4885 |
| −4.6264 | 5.9727 | 12.4885 |
| −4.8984 | 7.265 | 12.4885 |
| −6.7558 | 7.5785 | 12.4885 |
| −6.5481 | 5.9737 | 12.4885 |
| −5.4846 | 4.5786 | 12.4885 |
| −3.4727 | 4.0281 | 12.4885 |
| −4.2839 | 5.1922 | 12.4885 |
| −6.1894 | 5.3663 | 12.4885 |
| −4.9486 | 4.1202 | 12.4885 |
| −3.8234 | 4.4717 | 12.4885 |
| −4.526 | 5.7067 | 12.4885 |
| −5.7358 | 4.8263 | 12.4885 |
| −3.2816 | 3.8176 | 12.4885 |
| −4.3809 | 3.7017 | 12.4885 |
| −4.1436 | 4.9449 | 12.4885 |
| −6.3834 | 5.6613 | 12.4885 |

TABLE I-continued

| X Coordinate | Y Coordinate | Z Coordinate |
|---|---|---|
| −5.2214 | 4.3438 | 12.4885 |
| −3.6552 | 4.2462 | 12.4885 |
| −4.4116 | 5.4463 | 12.4885 |
| −5.9719 | 5.0885 | 12.4885 |
| −3.0829 | 3.6143 | 12.4885 |
| −4.668 | 3.9065 | 12.4885 |
| −3.9915 | 4.7046 | 12.4885 |
| −0.4549 | 1.6363 | 12.4885 |
| −4.0884 | 3.5047 | 12.4885 |
| −0.4462 | 1.6756 | 12.4885 |
| −2.6725 | 2.6747 | 12.4885 |
| −0.6154 | 1.7868 | 12.4885 |
| −1.498 | 2.0886 | 12.4885 |
| −1.0725 | 2.0653 | 12.4885 |
| −0.8017 | 1.7584 | 12.4885 |
| −1.8875 | 2.6134 | 12.4885 |
| −0.516 | 1.6237 | 12.4885 |
| −2.8796 | 3.4201 | 12.4885 |
| −0.452 | 1.6414 | 12.4885 |
| −3.5033 | 3.1397 | 12.4385 |
| −0.4867 | 1.7103 | 12.4885 |
| −2.16 | 2.4117 | 12.4885 |
| −0.7565 | 1.8713 | 12.4885 |
| −1.1585 | 1.9265 | 12.4885 |
| −1.3596 | 2.2495 | 12.4885 |
| −0.6477 | 1.6865 | 12.4885 |
| −2.2733 | 2.9045 | 12.4885 |
| −0.4639 | 1.6258 | 12.4885 |
| −0.4458 | 1.6559 | 12.4885 |
| −2.9415 | 2.8197 | 12.4885 |
| −0.5623 | 1.7552 | 12.4885 |
| −1.6993 | 2.1854 | 12.4885 |
| −0.9519 | 1.9902 | 12.4885 |
| −0.902 | 1.8054 | 12.4885 |
| −1.7023 | 2.4814 | 12.4885 |
| −0.5485 | 1.6409 | 12.4885 |
| −2.6749 | 3.2367 | 12.4885 |
| −0.452 | 1.6414 | 12.4885 |
| −3.7946 | 3.3168 | 12.4885 |
| −0.4604 | 1.6956 | 12.4885 |
| −2.4116 | 2.5393 | 12.4885 |
| −0.6798 | 1.8255 | 12.4885 |
| −1.3177 | 2.0024 | 12.4885 |
| −1.2086 | 2.1515 | 12.4885 |
| −0.7173 | 1.7189 | 12.4885 |
| −2.0781 | 2.7542 | 12.4885 |
| −0.4865 | 1.6157 | 12.4885 |
| −0.4497 | 1.6455 | 12.4885 |
| −3.2188 | 2.9741 | 12.4885 |
| −0.5196 | 1.73 | 12.4885 |
| −1.9212 | 2.2936 | 12.4885 |
| −0.8468 | 1.9258 | 12.4885 |
| −1.0204 | 1.8612 | 12.4885 |
| −1.5252 | 2.3599 | 12.4885 |
| −0.5922 | 1.6603 | 12.4885 |
| −2.4726 | 3.065 | 12.4885 |
| −4.8893 | 7.9317 | 10.7783 |
| −4.9065 | 8.6178 | 10.7783 |
| −5.124 | 8.9138 | 10.7783 |
| −5.0589 | 8.8741 | 10.7783 |
| −5.2323 | 8.9509 | 10.7783 |
| −5.5966 | 8.8878 | 10.7783 |
| −6.2195 | 8.3211 | 10.7783 |
| −4.8794 | 8.2611 | 10.7783 |
| −4.9628 | 8.7665 | 10.7783 |
| −5.1497 | 8.9248 | 10.7783 |
| −5.1021 | 8.9029 | 10.7783 |
| −5.3372 | 8.9591 | 10.7783 |
| −5.8266 | 8.7415 | 10.7783 |
| −6.4654 | 7.8932 | 10.7783 |
| −4.8897 | 8.5172 | 10.7783 |
| −5.1199 | 8.9118 | 10.7783 |
| −5.03 | 8.8507 | 10.7783 |
| −5.1977 | 8.9416 | 10.7783 |
| −5.1199 | 8.9118 | 10.7783 |
| −5.4977 | 8.9281 | 10.7783 |
| −6.0867 | 8.4902 | 10.7783 |

TABLE I-continued

| X Coordinate | Y Coordinate | Z Coordinate |
|---|---|---|
| −4.8829 | 8.1055 | 10.7783 |
| −4.9315 | 8.7006 | 10.7783 |
| −5.1334 | 8.9181 | 10.7783 |
| −5.0825 | 8.8911 | 10.7783 |
| −5.278 | 8.9572 | 10.7783 |
| −5.7067 | 8.8267 | 10.7783 |
| −6.3482 | 8.1214 | 10.7783 |
| −4.881 | 8.3984 | 10.7783 |
| −4.997 | 8.8157 | 10.7783 |
| −5.171 | 8.9326 | 10.7783 |
| −5.1144 | 8.9092 | 10.7783 |
| −5.4107 | 8.9508 | 10.7783 |
| −5.9545 | 8.6299 | 10.7783 |
| −6.5638 | 7.6401 | 10.7783 |
| −6.5781 | 6.1349 | 10.7783 |
| −4.7202 | 6.0918 | 10.7783 |
| −4.8969 | 7.3123 | 10.7783 |
| −6.6798 | 7.0754 | 10.7783 |
| −4.8314 | 6.6016 | 10.7783 |
| −4.8958 | 7.7395 | 10.7783 |
| −6.6536 | 6.4545 | 10.7783 |
| −4.6404 | 5.832 | 10.7783 |
| −4.8861 | 7.0837 | 10.7783 |
| −6.6371 | 7.3667 | 10.7783 |
| −6.4607 | 5.8203 | 10.7783 |
| −4.7837 | 6.3496 | 10.7783 |
| −4.8993 | 7.5321 | 10.7783 |
| −6.6867 | 6.7698 | 10.7783 |
| −4.865 | 6.8465 | 10.7783 |
| −5.6879 | 4.7121 | 10.7783 |
| −3.3362 | 3.7547 | 10.7783 |
| −4.3739 | 3.6453 | 10.7783 |
| −4.1757 | 4.8384 | 10.7783 |
| −6.3065 | 5.5177 | 10.7783 |
| −5.1902 | 4.2516 | 10.7783 |
| −3.7001 | 4.1661 | 10.7783 |
| −4.4351 | 5.3226 | 10.7783 |
| −5.9149 | 4.9641 | 10.7783 |
| −4.6529 | 3.8379 | 10.7783 |
| −4.0277 | 4.607 | 10.7783 |
| −5.4453 | 4.4751 | 10.7783 |
| −3.5222 | 3.9568 | 10.7783 |
| −4.3117 | 5.0771 | 10.7783 |
| −6.1228 | 5.2323 | 10.7783 |
| −4.9254 | 4.0397 | 10.7783 |
| −3.8688 | 4.3829 | 10.7783 |
| −4.5449 | 5.5744 | 10.7783 |
| −1.2767 | 1.9339 | 10.7783 |
| −1.4723 | 2.2481 | 10.7783 |
| −0.7882 | 1.6976 | 10.7783 |
| −2.3567 | 2.8784 | 10.7783 |
| −0.6123 | 1.639 | 10.7783 |
| −0.5948 | 1.668 | 10.7783 |
| −2.9824 | 2.8095 | 10.7783 |
| −0.7047 | 1.7661 | 10.7783 |
| −1.7936 | 2.1889 | 10.7783 |
| −1.0792 | 1.9962 | 10.7783 |
| −1.0314 | 1.8148 | 10.7783 |
| −1.8036 | 2.4718 | 10.7783 |
| −0.6934 | 1.6527 | 10.7783 |
| −2.7464 | 3.1972 | 10.7783 |
| −0.6009 | 1.654 | 10.7783 |
| −3.8051 | 3.283 | 10.7783 |
| −0.6069 | 1.7072 | 10.7783 |
| −2.4745 | 2.537 | 10.7783 |
| −0.8176 | 1.835 | 10.7783 |
| −1.4289 | 2.0085 | 10.7783 |
| −1.3265 | 2.1533 | 10.7783 |
| −0.8547 | 1.7295 | 10.7783 |
| −2.1676 | 2.734 | 10.7783 |
| −0.6338 | 1.6289 | 10.7783 |
| −3.1428 | 3.5596 | 10.7783 |
| −0.5986 | 1.6579 | 10.7783 |
| −3.249 | 2.9578 | 10.7783 |
| −0.6637 | 1.7413 | 10.7783 |
| −2.0056 | 2.2956 | 10.7783 |
| −0.9781 | 1.9334 | 10.7783 |

TABLE I-continued

| X Coordinate | Y Coordinate | Z Coordinate |
|---|---|---|
| −1.1446 | 1.8696 | 10.7783 |
| −1.6322 | 2.3547 | 10.7783 |
| −0.7352 | 1.6716 | 10.7783 |
| −2.5501 | 3.0324 | 10.7783 |
| −0.6037 | 1.6491 | 10.7783 |
| −4.0899 | 3.46 | 10.7783 |
| −0.5947 | 1.6868 | 10.7783 |
| −2.7242 | 2.6692 | 10.7783 |
| −0.7557 | 1.7971 | 10.7783 |
| −1.6013 | 2.0934 | 10.7783 |
| −1.1953 | 2.0694 | 10.7783 |
| −0.9354 | 1.7685 | 10.7783 |
| −1.9829 | 2.5988 | 10.7783 |
| −0.6625 | 1.635 | 10.7783 |
| −2.9452 | 3.3732 | 10.7783 |
| −0.6009 | 1.654 | 10.7783 |
| −3.5234 | 3.1155 | 10.7783 |
| −0.6322 | 1.722 | 10.7783 |
| −2.2338 | 2.4119 | 10.7783 |
| −0.8913 | 1.88 | 10.7783 |
| −5.7463 | 8.506 | 9.0671 |
| −4.8671 | 8.2419 | 9.0671 |
| −5.0727 | 8.6361 | 9.0671 |
| −4.9943 | 8.5675 | 9.0671 |
| −5.1433 | 8.6741 | 9.0671 |
| −5.0727 | 8.6361 | 9.0671 |
| −5.4307 | 8.6856 | 9.0671 |
| −5.9895 | 8.2576 | 9.0671 |
| −4.9094 | 8.4174 | 9.0671 |
| −5.0847 | 8.6438 | 9.0671 |
| −5.0397 | 8.6119 | 9.0671 |
| −5.2183 | 8.6976 | 9.0671 |
| −5.6324 | 8.5899 | 9.0671 |
| −6.2313 | 7.8965 | 9.0671 |
| −4.8548 | 8.1284 | 9.0671 |
| −4.9663 | 8.5308 | 9.0671 |
| −5.1186 | 8.6626 | 9.0671 |
| −5.0678 | 8.6329 | 9.0671 |
| −5.346 | 8.7028 | 9.0671 |
| −5.8664 | 8.3955 | 9.0671 |
| −4.8854 | 8.338 | 9.0671 |
| −5.0764 | 8.6386 | 9.0671 |
| −5.0189 | 8.5933 | 9.0671 |
| −5.1755 | 8.6861 | 9.0671 |
| −5.5267 | 8.6492 | 9.0671 |
| −6.1124 | 8.0915 | 9.0671 |
| −4.8485 | 7.9969 | 9.0671 |
| −4.9372 | 8.4814 | 9.0671 |
| −5.0994 | 8.6524 | 9.0671 |
| −5.057 | 8.6254 | 9.0671 |
| −5.2749 | 8.705 | 9.0671 |
| −4.7993 | 6.4045 | 9.0671 |
| −6.3397 | 7.6751 | 9.0671 |
| −4.8532 | 7.4965 | 9.0671 |
| −6.5346 | 6.2912 | 9.0671 |
| −4.845 | 6.8675 | 9.0671 |
| −6.5017 | 7.168 | 9.0671 |
| −4.8474 | 7.8476 | 9.0671 |
| −4.758 | 6.1621 | 9.0671 |
| −4.8554 | 7.2975 | 9.0671 |
| −6.5578 | 6.595 | 9.0671 |
| −4.8276 | 6.6399 | 9.0671 |
| −6.4317 | 7.4308 | 9.0671 |
| −4.8497 | 7.6808 | 9.0671 |
| −6.4724 | 5.9818 | 9.0671 |
| −4.7018 | 5.9137 | 9.0671 |
| −4.8535 | 7.0868 | 9.0671 |
| −6.5453 | 6.8885 | 9.0671 |
| −4.6296 | 5.6633 | 9.0671 |
| −6.3704 | 5.6755 | 9.0671 |
| −6.2312 | 5.3802 | 9.0671 |
| −5.8649 | 4.841 | 9.0671 |
| −4.645 | 3.7674 | 9.0671 |
| −4.0501 | 4.4852 | 9.0671 |
| −5.4142 | 4.3702 | 9.0671 |
| −3.5597 | 3.8662 | 9.0671 |
| −4.3224 | 4.9361 | 9.0671 |

TABLE I-continued

| X Coordinate | Y Coordinate | Z Coordinate |
|---|---|---|
| −6.061 | 5.1017 | 9.0671 |
| −4.91 | 3.9572 | 9.0671 |
| −3.8964 | 4.2712 | 9.0671 |
| −4.5416 | 5.415 | 9.0671 |
| −5.6481 | 4.5975 | 9.0671 |
| −3.3787 | 3.6748 | 9.0671 |
| −4.1925 | 4.7069 | 9.0671 |
| −5.1672 | 4.1575 | 9.0671 |
| −3.7326 | 4.0649 | 9.0671 |
| −4.439 | 5.1723 | 9.0671 |
| −2.5424 | 2.5303 | 9.0671 |
| −0.9543 | 1.8434 | 9.0671 |
| −1.5419 | 2.0134 | 9.0671 |
| −1.4397 | 2.1525 | 9.0671 |
| −0.9926 | 1.7398 | 9.0671 |
| −2.2465 | 2.7092 | 9.0671 |
| −0.781 | 1.6421 | 9.0671 |
| −3.1907 | 3.4903 | 9.0671 |
| −0.7477 | 1.6706 | 9.0671 |
| −3.2856 | 2.9372 | 9.0671 |
| −0.8075 | 1.7522 | 9.0671 |
| −2.0937 | 2.2944 | 9.0671 |
| −1.1073 | 1.9391 | 9.0671 |
| −1.2699 | 1.8773 | 9.0671 |
| −1.7322 | 2.3469 | 9.0671 |
| −0.8784 | 1.6829 | 9.0671 |
| −2.6158 | 2.9922 | 9.0671 |
| −0.7525 | 1.662 | 9.0671 |
| −4.0982 | 3.4127 | 9.0671 |
| −0.7435 | 1.698 | 9.0671 |
| −2.7815 | 2.659 | 9.0671 |
| −0.8952 | 1.8065 | 9.0671 |
| −1.7068 | 2.0965 | 9.0671 |
| −1.3145 | 2.0713 | 9.0671 |
| −1.0697 | 1.7782 | 9.0671 |
| −2.0687 | 2.5805 | 9.0671 |
| −0.8088 | 1.647 | 9.0671 |
| −2.9987 | 3.3143 | 9.0671 |
| −0.7498 | 1.6667 | 9.0671 |
| −3.55 | 3.0876 | 9.0671 |
| −0.7774 | 1.7336 | 9.0671 |
| −2.312 | 2.4082 | 9.0671 |
| −1.0245 | 1.8872 | 9.0671 |
| −1.3962 | 1.9403 | 9.0671 |
| −1.5791 | 2.2442 | 9.0671 |
| −0.9291 | 1.7084 | 9.0671 |
| −2.4289 | 2.8464 | 9.0671 |
| −0.7607 | 1.6523 | 9.0671 |
| −4.3738 | 3.5866 | 9.0671 |
| −0.7439 | 1.6802 | 9.0671 |
| −3.0293 | 2.7946 | 9.0671 |
| −0.8466 | 1.7763 | 9.0671 |
| −1.8908 | 2.1901 | 9.0671 |
| −1.2037 | 2.0003 | 9.0671 |
| −1.1615 | 1.8236 | 9.0671 |
| −1.8965 | 2.4592 | 9.0671 |
| −0.8385 | 1.664 | 9.0671 |
| −2.8059 | 3.1481 | 9.0671 |
| −0.7498 | 1.6667 | 9.0671 |
| −3.8223 | 3.2461 | 9.0671 |
| −0.7534 | 1.7187 | 9.0671 |
| −5.1618 | 8.4428 | 7.3559 |
| −5.5567 | 8.3304 | 7.3559 |
| −6.1298 | 7.6615 | 7.3559 |
| −4.8191 | 7.0932 | 7.3559 |
| −4.8201 | 7.8924 | 7.3559 |
| −4.9196 | 8.2811 | 7.3559 |
| −5.0666 | 8.4077 | 7.3559 |
| −5.0185 | 8.378 | 7.3559 |
| −5.2846 | 8.4463 | 7.3559 |
| −5.7788 | 8.1407 | 7.3559 |
| −6.3272 | 7.2164 | 7.3559 |
| −4.8164 | 7.4619 | 7.3559 |
| −4.8447 | 8.0946 | 7.3559 |
| −5.0266 | 8.3836 | 7.3559 |
| −4.9711 | 8.3403 | 7.3559 |
| −5.1209 | 8.4313 | 7.3559 |

TABLE I-continued

| X Coordinate | Y Coordinate | Z Coordinate |
|---|---|---|
| −5.4566 | 8.3896 | 7.3559 |
| −6.0147 | 7.8482 | 7.3559 |
| −4.8156 | 7.7658 | 7.3559 |
| −4.8914 | 8.2336 | 7.3559 |
| −5.0484 | 8.3975 | 7.3559 |
| −5.0082 | 8.3707 | 7.3559 |
| −5.2162 | 8.4497 | 7.3559 |
| −5.6647 | 8.248 | 7.3559 |
| −6.2359 | 7.4499 | 7.3559 |
| −4.8185 | 7.2846 | 7.3559 |
| −4.8294 | 8.0018 | 7.3559 |
| −5.0231 | 8.3812 | 7.3559 |
| −4.9471 | 8.3159 | 7.3559 |
| −5.0901 | 8.4191 | 7.3559 |
| −5.0231 | 8.3812 | 7.3559 |
| −5.3654 | 8.4273 | 7.3559 |
| −5.8965 | 8.0076 | 7.3559 |
| −4.8149 | 7.6223 | 7.3559 |
| −4.8657 | 8.1715 | 7.3559 |
| −5.0345 | 8.3889 | 7.3559 |
| −4.9914 | 8.3579 | 7.3559 |
| −4.7324 | 6.0002 | 7.3559 |
| −6.4616 | 6.4156 | 7.3559 |
| −4.7923 | 6.4607 | 7.3559 |
| −6.3892 | 5.8253 | 7.3559 |
| −4.684 | 5.7601 | 7.3559 |
| −4.8162 | 6.8906 | 7.3559 |
| −6.4447 | 6.6973 | 7.3559 |
| −4.7678 | 6.234 | 7.3559 |
| −6.4444 | 6.1234 | 7.3559 |
| −4.8078 | 6.6797 | 7.3559 |
| −6.3983 | 6.965 | 7.3559 |
| −4.3445 | 4.8105 | 7.3559 |
| −6.001 | 4.977 | 7.3559 |
| −4.8941 | 3.8792 | 7.3559 |
| −3.9415 | 4.167 | 7.3559 |
| −4.5435 | 5.2764 | 7.3559 |
| −5.6046 | 4.4923 | 7.3559 |
| −4.2235 | 4.5879 | 7.3559 |
| −6.1632 | 5.2452 | 7.3559 |
| −5.1418 | 4.0708 | 7.3559 |
| −3.783 | 3.9694 | 7.3559 |
| −4.4513 | 5.0403 | 7.3559 |
| −5.8131 | 4.7262 | 7.3559 |
| −4.6392 | 3.6974 | 7.3559 |
| −4.0888 | 4.3733 | 7.3559 |
| −4.6212 | 5.5176 | 7.3559 |
| −6.2945 | 5.53 | 7.3559 |
| −5.3797 | 4.2745 | 7.3559 |
| −3.6146 | 3.7802 | 7.3559 |
| −4.1135 | 3.3575 | 7.3559 |
| −0.8925 | 1.7097 | 7.3559 |
| −2.8486 | 2.6339 | 7.3559 |
| −1.0366 | 1.8156 | 7.3559 |
| −1.8158 | 2.0945 | 7.3559 |
| −1.4383 | 2.0727 | 7.3559 |
| −1.2052 | 1.7861 | 7.3559 |
| −2.1617 | 2.5653 | 7.3559 |
| −0.9552 | 1.6588 | 7.3559 |
| −3.0653 | 3.2596 | 7.3559 |
| −0.8988 | 1.6797 | 7.3559 |
| −3.587 | 3.0452 | 7.3559 |
| −0.9234 | 1.7454 | 7.3559 |
| −2.3973 | 2.3936 | 7.3559 |
| −1.1606 | 1.8937 | 7.3559 |
| −1.518 | 1.9435 | 7.3559 |
| −1.6916 | 2.2406 | 7.3559 |
| −1.0705 | 1.7182 | 7.3559 |
| −2.5099 | 2.8186 | 7.3559 |
| −0.9092 | 1.6657 | 7.3559 |
| −3.4375 | 3.599 | 7.3559 |
| −4.3784 | 3.5243 | 7.3559 |
| −0.8932 | 1.6927 | 7.3559 |
| −3.0867 | 2.7639 | 7.3559 |
| −0.9899 | 1.7865 | 7.3559 |
| −1.9925 | 2.1844 | 7.3559 |
| −1.3322 | 2.0036 | 7.3559 |

TABLE I-continued

| X Coordinate | Y Coordinate | Z Coordinate |
|---|---|---|
| −1.2931 | 1.8302 | 7.3559 |
| −1.996 | 2.4487 | 7.3559 |
| −0.9838 | 1.675 | 7.3559 |
| −2.8767 | 3.1033 | 7.3559 |
| −0.8988 | 1.6797 | 7.3559 |
| −3.8484 | 3.1975 | 7.3559 |
| −0.9005 | 1.7304 | 7.3559 |
| −2.6187 | 2.5106 | 7.3559 |
| −1.0933 | 1.8512 | 7.3559 |
| −1.6576 | 2.0142 | 7.3559 |
| −1.5582 | 2.1516 | 7.3559 |
| −1.1314 | 1.7488 | 7.3559 |
| −2.3332 | 2.6883 | 7.3559 |
| −0.9283 | 1.6554 | 7.3559 |
| −3.2532 | 3.4251 | 7.3559 |
| −0.8968 | 1.6834 | 7.3559 |
| −3.333 | 2.9008 | 7.3559 |
| −0.9524 | 1.763 | 7.3559 |
| −2.1874 | 2.2845 | 7.3559 |
| −1.2399 | 1.9442 | 7.3559 |
| −1.3969 | 1.8824 | 7.3559 |
| −1.8384 | 2.3402 | 7.3559 |
| −1.0219 | 1.6935 | 7.3559 |
| −2.6914 | 2.9565 | 7.3559 |
| −0.9014 | 1.6751 | 7.3559 |
| −4.9682 | 8.1312 | 5.6457 |
| −4.9146 | 8.0901 | 5.6457 |
| −5.0586 | 8.1774 | 5.6457 |
| −5.3816 | 8.1404 | 5.6457 |
| −5.9227 | 7.626 | 5.6457 |
| −4.7728 | 7.5394 | 5.6457 |
| −4.836 | 7.9892 | 5.6457 |
| −4.9891 | 8.1445 | 5.6457 |
| −4.9505 | 8.1189 | 5.6457 |
| −5.15 | 8.1955 | 5.6457 |
| −5.5832 | 8.0071 | 5.6457 |
| −6.137 | 7.2445 | 5.6457 |
| −4.7874 | 7.0778 | 5.6457 |
| −4.7799 | 7.7661 | 5.6457 |
| −4.9649 | 8.1289 | 5.6457 |
| −4.891 | 8.0672 | 5.6457 |
| −5.0291 | 8.1655 | 5.6457 |
| −4.9649 | 8.1289 | 5.6457 |
| −5.2936 | 8.1754 | 5.6457 |
| −5.8081 | 7.7784 | 5.6457 |
| −4.776 | 7.4017 | 5.6457 |
| −4.8114 | 7.9296 | 5.6457 |
| −4.9758 | 8.1362 | 5.6457 |
| −4.9343 | 8.1066 | 5.6457 |
| −5.0978 | 8.1885 | 5.6457 |
| −5.4786 | 8.0849 | 5.6457 |
| −6.0342 | 7.4473 | 5.6457 |
| −4.7736 | 7.6609 | 5.6457 |
| −4.8638 | 8.0345 | 5.6457 |
| −5.0066 | 8.1544 | 5.6457 |
| −4.9604 | 8.1259 | 5.6457 |
| −5.2158 | 8.1928 | 5.6457 |
| −5.694 | 7.9052 | 5.6457 |
| −4.7815 | 7.2478 | 5.6457 |
| −4.7923 | 7.8555 | 5.6457 |
| −4.7924 | 6.6997 | 5.6457 |
| −6.343 | 6.5231 | 5.6457 |
| −4.7544 | 6.069 | 5.6457 |
| −6.3505 | 5.9719 | 5.6457 |
| −4.7876 | 6.4971 | 5.6457 |
| −6.2959 | 6.7798 | 5.6457 |
| −4.7224 | 5.8443 | 5.6457 |
| −4.7917 | 6.8941 | 5.6457 |
| −6.3627 | 6.2528 | 5.6457 |
| −4.7755 | 6.2868 | 5.6457 |
| −6.2259 | 7.0207 | 5.6457 |
| −6.3023 | 5.6848 | 5.6457 |
| −5.5654 | 4.3958 | 5.6457 |
| −4.2365 | 4.4885 | 5.6457 |
| −4.6776 | 5.6136 | 5.6457 |
| −6.0947 | 5.1241 | 5.6457 |
| −5.1219 | 3.9897 | 5.6457 |

TABLE I-continued

| X Coordinate | Y Coordinate | Z Coordinate |
|---|---|---|
| −3.811 | 3.8969 | 5.6457 |
| −4.4559 | 4.9222 | 5.6457 |
| −5.7641 | 4.6217 | 5.6457 |
| −4.6394 | 3.6309 | 5.6457 |
| −4.1065 | 4.283 | 5.6457 |
| −4.6183 | 5.3805 | 5.6457 |
| −6.2164 | 5.3996 | 5.6457 |
| −5.3501 | 4.1857 | 5.6457 |
| −3.6484 | 3.7161 | 5.6457 |
| −4.3532 | 4.7018 | 5.6457 |
| −5.9423 | 4.8644 | 5.6457 |
| −4.8842 | 3.8055 | 5.6457 |
| −3.9642 | 4.0857 | 5.6457 |
| −4.5443 | 5.1488 | 5.6457 |
| −1.0579 | 1.6788 | 5.6457 |
| −3.4775 | 3.5431 | 5.6457 |
| −4.3889 | 3.4646 | 5.6457 |
| −1.0425 | 1.7048 | 5.6457 |
| −3.1479 | 2.7349 | 5.6457 |
| −1.1331 | 1.7964 | 5.6457 |
| −2.0965 | 2.1792 | 5.6457 |
| −1.4601 | 2.0072 | 5.6457 |
| −1.4259 | 1.8367 | 5.6457 |
| −2.0941 | 2.4389 | 5.6457 |
| −1.1296 | 1.6861 | 5.6457 |
| −2.9379 | 3.0691 | 5.6457 |
| −1.048 | 1.6923 | 5.6457 |
| −3.8799 | 3.1507 | 5.6457 |
| −1.0484 | 1.7411 | 5.6457 |
| −2.698 | 2.4923 | 5.6457 |
| −1.2319 | 1.8592 | 5.6457 |
| −1.7752 | 2.015 | 5.6457 |
| −1.676 | 2.1508 | 5.6457 |
| −1.2709 | 1.7577 | 5.6457 |
| −2.4167 | 2.6703 | 5.6457 |
| −1.076 | 1.6686 | 5.6457 |
| −3.3 | 3.377 | 5.6457 |
| −1.046 | 1.6959 | 5.6457 |
| −3.3846 | 2.866 | 5.6457 |
| −1.0974 | 1.7735 | 5.6457 |
| −2.2836 | 2.2756 | 5.6457 |
| −1.3719 | 1.9495 | 5.6457 |
| −1.5253 | 1.8873 | 5.6457 |
| −1.9435 | 2.3337 | 5.6457 |
| −1.166 | 1.7042 | 5.6457 |
| −2.76 | 2.9283 | 5.6457 |
| −1.0505 | 1.6879 | 5.6457 |
| −4.1344 | 3.3044 | 5.6457 |
| −1.0415 | 1.721 | 5.6457 |
| −2.9191 | 2.6103 | 5.6457 |
| −1.1778 | 1.8246 | 5.6457 |
| −1.9269 | 2.0926 | 5.6457 |
| −1.5615 | 2.0742 | 5.6457 |
| −1.3417 | 1.7938 | 5.6457 |
| −2.2526 | 2.5515 | 5.6457 |
| −1.1019 | 1.6708 | 5.6457 |
| −3.1191 | 3.2187 | 5.6457 |
| −1.048 | 1.6923 | 5.6457 |
| −3.6387 | 3.0045 | 5.6457 |
| −1.0693 | 1.7569 | 5.6457 |
| −2.4852 | 2.3801 | 5.6457 |
| −1.2962 | 1.9005 | 5.6457 |
| −1.6414 | 1.9465 | 5.6457 |
| −1.8034 | 2.2372 | 5.6457 |
| −1.2126 | 1.7281 | 5.6457 |
| −2.5859 | 2.7958 | 5.6457 |
| −4.7213 | 7.5254 | 3.9345 |
| −4.8997 | 7.8728 | 3.9345 |
| −4.8303 | 7.8124 | 3.9345 |
| −4.9606 | 7.9091 | 3.9345 |
| −4.8997 | 7.8728 | 3.9345 |
| −5.2146 | 7.9313 | 3.9345 |
| −5.7224 | 7.571 | 3.9345 |
| −4.7282 | 7.1771 | 3.9345 |
| −4.7527 | 7.6815 | 3.9345 |
| −4.91 | 7.8799 | 3.9345 |
| −4.871 | 7.8508 | 3.9345 |

TABLE I-continued

| X Coordinate | Y Coordinate | Z Coordinate |
|---|---|---|
| −5.0261 | 7.9329 | 3.9345 |
| −5.3973 | 7.8555 | 3.9345 |
| −5.9411 | 7.2542 | 3.9345 |
| −4.717 | 7.4248 | 3.9345 |
| −4.8044 | 7.7809 | 3.9345 |
| −4.9394 | 7.8978 | 3.9345 |
| −4.8955 | 7.8698 | 3.9345 |
| −5.1389 | 7.9428 | 3.9345 |
| −5.6104 | 7.6906 | 3.9345 |
| −4.7333 | 7.611 | 3.9345 |
| −4.9029 | 7.875 | 3.9345 |
| −4.8526 | 7.8345 | 3.9345 |
| −4.9887 | 7.9212 | 3.9345 |
| −5.3012 | 7.9033 | 3.9345 |
| −5.8337 | 7.4256 | 3.9345 |
| −4.7197 | 7.3086 | 3.9345 |
| −4.7774 | 7.738 | 3.9345 |
| −4.9228 | 7.8881 | 3.9345 |
| −4.8861 | 7.8629 | 3.9345 |
| −5.0758 | 7.9418 | 3.9345 |
| −5.501 | 7.785 | 3.9345 |
| −6.0395 | 7.0592 | 3.9345 |
| −6.2506 | 5.8372 | 3.9345 |
| −4.7743 | 6.3136 | 3.9345 |
| −6.1911 | 6.6127 | 3.9345 |
| −4.7182 | 5.689 | 3.9345 |
| −4.7653 | 6.6931 | 3.9345 |
| −6.2583 | 6.107 | 3.9345 |
| −4.7669 | 6.1123 | 3.9345 |
| −6.1242 | 6.8441 | 3.9345 |
| −4.7402 | 7.0304 | 3.9345 |
| −4.7731 | 6.5073 | 3.9345 |
| −6.237 | 6.3664 | 3.9345 |
| −4.7489 | 5.9038 | 3.9345 |
| −4.7535 | 6.8683 | 3.9345 |
| −5.7163 | 4.5288 | 3.9345 |
| −4.1 | 4.2085 | 3.9345 |
| −4.6127 | 5.247 | 3.9345 |
| −6.1343 | 5.2849 | 3.9345 |
| −5.3238 | 4.1054 | 3.9345 |
| −3.66 | 3.6682 | 3.9345 |
| −4.3434 | 4.6045 | 3.9345 |
| −5.8831 | 4.7649 | 3.9345 |
| −4.8784 | 3.7379 | 3.9345 |
| −3.9621 | 4.0214 | 3.9345 |
| −4.5368 | 5.0272 | 3.9345 |
| −6.2101 | 5.5606 | 3.9345 |
| −5.5285 | 4.3092 | 3.9345 |
| −4.2274 | 4.403 | 3.9345 |
| −4.6732 | 5.4688 | 3.9345 |
| −6.0239 | 5.0175 | 3.9345 |
| −5.106 | 3.9157 | 3.9345 |
| −3.8149 | 3.8415 | 3.9345 |
| −4.4469 | 4.8127 | 3.9345 |
| −1.4114 | 1.7666 | 3.9345 |
| −2.496 | 2.6523 | 3.9345 |
| −1.2242 | 1.6818 | 3.9345 |
| −3.3302 | 3.3406 | 3.9345 |
| −4.6438 | 3.5696 | 3.9345 |
| −1.1955 | 1.708 | 3.9345 |
| −3.4389 | 2.8352 | 3.9345 |
| −1.2425 | 1.7836 | 3.9345 |
| −2.3818 | 2.2679 | 3.9345 |
| −1.5032 | 1.9545 | 3.9345 |
| −1.6552 | 1.8921 | 3.9345 |
| −2.0469 | 2.3259 | 3.9345 |
| −1.3108 | 1.715 | 3.9345 |
| −2.8207 | 2.9036 | 3.9345 |
| −1.1999 | 1.7005 | 3.9345 |
| −4.1592 | 3.2556 | 3.9345 |
| −1.1908 | 1.732 | 3.9345 |
| −2.9916 | 2.5901 | 3.9345 |
| −1.3187 | 1.8334 | 3.9345 |
| −2.04 | 2.0908 | 3.9345 |
| −1.6835 | 2.0752 | 3.9345 |
| −1.4793 | 1.8015 | 3.9345 |
| −2.3405 | 2.5369 | 3.9345 |

TABLE I-continued

| X Coordinate | Y Coordinate | Z Coordinate |
|---|---|---|
| −1.2492 | 1.6829 | 3.9345 |
| −3.1596 | 3.1867 | 3.9345 |
| −1.1975 | 1.7047 | 3.9345 |
| −3.6734 | 2.9679 | 3.9345 |
| −1.2154 | 1.7678 | 3.9345 |
| −2.5751 | 2.3689 | 3.9345 |
| −1.4312 | 1.9071 | 3.9345 |
| −1.7664 | 1.9494 | 3.9345 |
| −1.9136 | 2.2327 | 3.9345 |
| −1.3555 | 1.738 | 3.9345 |
| −2.6562 | 2.7744 | 3.9345 |
| −1.2071 | 1.6917 | 3.9345 |
| −3.498 | 3.5015 | 3.9345 |
| −4.4035 | 3.4095 | 3.9345 |
| −1.1921 | 1.7165 | 3.9345 |
| −3.2114 | 2.7096 | 3.9345 |
| −1.2762 | 1.8061 | 3.9345 |
| −2.2024 | 2.1748 | 3.9345 |
| −1.587 | 2.0103 | 3.9345 |
| −1.5599 | 1.843 | 3.9345 |
| −2.19 | 2.4277 | 3.9345 |
| −1.276 | 1.6974 | 3.9345 |
| −2.9886 | 3.0409 | 3.9345 |
| −1.1975 | 1.7047 | 3.9345 |
| −3.9147 | 3.1081 | 3.9345 |
| −1.1966 | 1.7513 | 3.9345 |
| −2.7793 | 2.4768 | 3.9345 |
| −1.3701 | 1.867 | 3.9345 |
| −1.8946 | 2.0157 | 3.9345 |
| −1.7924 | 2.1492 | 3.9345 |
| −5.8514 | 7.0584 | 2.2243 |
| −4.6618 | 7.1776 | 2.2243 |
| −4.7523 | 7.5151 | 2.2243 |
| −4.8732 | 7.6352 | 2.2243 |
| −4.834 | 7.6045 | 2.2243 |
| −5.0612 | 7.6907 | 2.2243 |
| −5.522 | 7.467 | 2.2243 |
| −4.6823 | 7.3542 | 2.2243 |
| −4.8405 | 7.61 | 2.2243 |
| −4.7955 | 7.5683 | 2.2243 |
| −4.919 | 7.6605 | 2.2243 |
| −5.2184 | 7.6602 | 2.2243 |
| −5.7439 | 7.2199 | 2.2243 |
| −4.6635 | 7.0671 | 2.2243 |
| −4.7271 | 7.474 | 2.2243 |
| −4.8582 | 7.6244 | 2.2243 |
| −4.8257 | 7.5972 | 2.2243 |
| −5.0009 | 7.6862 | 2.2243 |
| −5.4141 | 7.554 | 2.2243 |
| −4.6681 | 7.2733 | 2.2243 |
| −4.8377 | 7.6076 | 2.2243 |
| −4.7757 | 7.5459 | 2.2243 |
| −4.893 | 7.647 | 2.2243 |
| −4.8377 | 7.6076 | 2.2243 |
| −5.1343 | 7.6834 | 2.2243 |
| −5.633 | 7.3559 | 2.2243 |
| −4.7028 | 7.4207 | 2.2243 |
| −4.8469 | 7.6153 | 2.2243 |
| −4.812 | 7.5848 | 2.2243 |
| −4.9538 | 7.6746 | 2.2243 |
| −5.3122 | 7.6177 | 2.2243 |
| −4.7172 | 6.4827 | 2.2243 |
| −6.1707 | 5.9638 | 2.2243 |
| −4.7299 | 5.9305 | 2.2243 |
| −6.0351 | 6.6689 | 2.2243 |
| −4.6857 | 6.8028 | 2.2243 |
| −4.7289 | 6.3062 | 2.2243 |
| −6.1488 | 6.2123 | 2.2243 |
| −4.7146 | 5.7321 | 2.2243 |
| −5.9501 | 6.8737 | 2.2243 |
| −4.7018 | 6.6489 | 2.2243 |
| −6.1645 | 5.705 | 2.2243 |
| −4.7339 | 6.122 | 2.2243 |
| −6.1024 | 6.448 | 2.2243 |
| −4.6721 | 6.9421 | 2.2243 |
| −5.8189 | 4.6744 | 2.2243 |
| −4.8686 | 3.6773 | 2.2243 |

TABLE I-continued

| X Coordinate | Y Coordinate | Z Coordinate |
|---|---|---|
| −3.9505 | 3.9493 | 2.2243 |
| −4.5078 | 4.9 | 2.2243 |
| −6.1267 | 5.4397 | 2.2243 |
| −5.4844 | 4.2333 | 2.2243 |
| −4.205 | 4.3107 | 2.2243 |
| −4.6423 | 5.3184 | 2.2243 |
| −5.9515 | 4.9179 | 2.2243 |
| −5.0846 | 3.8505 | 2.2243 |
| −3.8109 | 3.7779 | 2.2243 |
| −4.4191 | 4.6974 | 2.2243 |
| −5.6617 | 4.4462 | 2.2243 |
| −4.0823 | 4.1268 | 2.2243 |
| −4.5827 | 5.108 | 2.2243 |
| −6.0555 | 5.1749 | 2.2243 |
| −5.2909 | 4.0352 | 2.2243 |
| −3.6647 | 3.6121 | 2.2243 |
| −4.3177 | 4.5009 | 2.2243 |
| −4.686 | 5.5277 | 2.2243 |
| −2.1542 | 2.087 | 2.2243 |
| −1.8048 | 2.0737 | 2.2243 |
| −1.6172 | 1.8086 | 2.2243 |
| −2.4265 | 2.5171 | 2.2243 |
| −1.3965 | 1.695 | 2.2243 |
| −3.1957 | 3.1471 | 2.2243 |
| −1.347 | 1.717 | 2.2243 |
| −3.7187 | 2.9309 | 2.2243 |
| −1.3618 | 1.7782 | 2.2243 |
| −2.6664 | 2.3554 | 2.2243 |
| −1.5659 | 1.9124 | 2.2243 |
| −1.8923 | 1.9508 | 2.2243 |
| −2.0228 | 2.2247 | 2.2243 |
| −1.4986 | 1.7477 | 2.2243 |
| −2.7239 | 2.7468 | 2.2243 |
| −1.3562 | 1.7046 | 2.2243 |
| −3.5126 | 3.4517 | 2.2243 |
| −4.4165 | 3.3578 | 2.2243 |
| −1.3417 | 1.7282 | 2.2243 |
| −3.276 | 2.6828 | 2.2243 |
| −1.4193 | 1.8151 | 2.2243 |
| −2.3097 | 2.168 | 2.2243 |
| −1.7134 | 2.0115 | 2.2243 |
| −1.6945 | 1.8485 | 2.2243 |
| −2.2845 | 2.4118 | 2.2243 |
| −1.4224 | 1.7087 | 2.2243 |
| −3.0357 | 3.0054 | 2.2243 |
| −1.347 | 1.717 | 2.2243 |
| −3.9497 | 3.0659 | 2.2243 |
| −1.3449 | 1.7614 | 2.2243 |
| −2.862 | 2.4592 | 2.2243 |
| −1.5081 | 1.8739 | 2.2243 |
| −2.0151 | 2.0146 | 2.2243 |
| −1.9079 | 2.1447 | 2.2243 |
| −1.5522 | 1.7752 | 2.2243 |
| −2.5732 | 2.6285 | 2.2243 |
| −1.3725 | 1.6951 | 2.2243 |
| −3.3554 | 3.2963 | 2.2243 |
| −4.6455 | 3.5134 | 2.2243 |
| −1.3451 | 1.7202 | 2.2243 |
| −3.4941 | 2.8033 | 2.2243 |
| −1.3875 | 1.7933 | 2.2243 |
| −2.4813 | 2.258 | 2.2243 |
| −1.6341 | 1.9579 | 2.2243 |
| −1.7858 | 1.8956 | 2.2243 |
| −2.149 | 2.3142 | 2.2243 |
| −1.4557 | 1.7256 | 2.2243 |
| −2.8783 | 2.8721 | 2.2243 |
| −1.3493 | 1.713 | 2.2243 |
| −4.1834 | 3.2085 | 2.2243 |
| −1.3401 | 1.7428 | 2.2243 |
| −3.0653 | 2.5681 | 2.2243 |
| −1.4595 | 1.8414 | 2.2243 |
| −5.1338 | 7.4055 | 0.5131 |
| −4.7135 | 7.2347 | 0.5131 |
| −4.7801 | 7.3279 | 0.5131 |
| −4.8004 | 7.3498 | 0.5131 |
| −4.9261 | 7.4283 | 0.5131 |
| −4.6454 | 7.0831 | 0.5131 |

TABLE I-continued

| X Coordinate | Y Coordinate | Z Coordinate |
|---|---|---|
| −5.3198 | 7.3017 | 0.5131 |
| −4.7496 | 7.2884 | 0.5131 |
| −4.7832 | 7.3313 | 0.5131 |
| −4.8288 | 7.3775 | 0.5131 |
| −5.0537 | 7.4294 | 0.5131 |
| −4.6912 | 7.195 | 0.5131 |
| −5.5349 | 7.1184 | 0.5131 |
| −4.7731 | 7.3201 | 0.5131 |
| −4.7907 | 7.3397 | 0.5131 |
| −4.8825 | 7.4119 | 0.5131 |
| −4.6265 | 7.0079 | 0.5131 |
| −5.2228 | 7.3633 | 0.5131 |
| −4.733 | 7.2655 | 0.5131 |
| −4.7832 | 7.3313 | 0.5131 |
| −4.8133 | 7.3618 | 0.5131 |
| −4.7902 | 7.3391 | 0.5131 |
| −4.9837 | 7.4359 | 0.5131 |
| −4.7902 | 7.3391 | 0.5131 |
| −4.6678 | 7.1449 | 0.5131 |
| −5.4245 | 7.2203 | 0.5131 |
| −4.7629 | 7.306 | 0.5131 |
| −4.7855 | 7.3339 | 0.5131 |
| −4.8512 | 7.3946 | 0.5131 |
| −5.6488 | 6.9949 | 0.5131 |
| −6.0946 | 6.058 | 0.5131 |
| −4.641 | 5.7382 | 0.5131 |
| −4.6142 | 6.5634 | 0.5131 |
| −5.8705 | 6.6793 | 0.5131 |
| −4.6418 | 6.0932 | 0.5131 |
| −4.6073 | 6.8139 | 0.5131 |
| −6.0421 | 6.282 | 0.5131 |
| −4.6237 | 6.4176 | 0.5131 |
| −5.7626 | 6.8483 | 0.5131 |
| −6.1182 | 5.8202 | 0.5131 |
| −4.6449 | 5.9192 | 0.5131 |
| −4.6081 | 6.6956 | 0.5131 |
| −5.9657 | 6.4896 | 0.5131 |
| −4.6339 | 6.2601 | 0.5131 |
| −4.6136 | 6.9182 | 0.5131 |
| −3.9445 | 3.8499 | 0.5131 |
| −4.4494 | 4.7602 | 0.5131 |
| −5.8809 | 4.8262 | 0.5131 |
| −5.0531 | 3.7999 | 0.5131 |
| −4.1782 | 4.196 | 0.5131 |
| −6.1093 | 5.5725 | 0.5131 |
| −4.5661 | 5.1587 | 0.5131 |
| −3.8149 | 3.686 | 0.5131 |
| −4.371 | 4.5665 | 0.5131 |
| −5.9884 | 5.0687 | 0.5131 |
| −4.6278 | 5.5507 | 0.5131 |
| −5.2461 | 3.9815 | 0.5131 |
| −4.066 | 4.0198 | 0.5131 |
| −4.5147 | 4.9586 | 0.5131 |
| −5.7488 | 4.5961 | 0.5131 |
| −4.851 | 3.6284 | 0.5131 |
| −4.2803 | 4.3783 | 0.5131 |
| −6.0658 | 5.3195 | 0.5131 |
| −4.6034 | 5.3572 | 0.5131 |
| −5.428 | 4.1743 | 0.5131 |
| −3.3433 | 2.6515 | 0.5131 |
| −3.2386 | 3.0854 | 0.5131 |
| −2.4194 | 2.1566 | 0.5131 |
| −1.4965 | 1.7297 | 0.5131 |
| −1.8297 | 1.8526 | 0.5131 |
| −1.5086 | 1.7883 | 0.5131 |
| −1.5688 | 1.7197 | 0.5131 |
| −1.7014 | 1.9152 | 0.5131 |
| −1.4965 | 1.7297 | 0.5131 |
| −2.1328 | 2.2108 | 0.5131 |
| −3.9851 | 3.0234 | 0.5131 |
| −1.4965 | 1.7297 | 0.5131 |
| −2.7941 | 2.0756 | 0.5131 |
| −2.9476 | 2.4363 | 0.5131 |
| −1.4965 | 1.7297 | 0.5131 |
| −3.5362 | 3.375 | 0.5131 |
| −2.1373 | 2.0101 | 0.5131 |
| −1.4915 | 1.7403 | 0.5131 |

TABLE I-continued

| X Coordinate | Y Coordinate | Z Coordinate |
|---|---|---|
| −1.6931 | 1.783 | 0.5131 |
| −1.5628 | 1.8234 | 0.5131 |
| −1.5206 | 1.7085 | 0.5131 |
| −1.8408 | 2.0089 | 0.5131 |
| −4.6419 | 3.4656 | 0.5131 |
| −2.3796 | 2.3882 | 0.5131 |
| −3.5514 | 2.7679 | 0.5131 |
| −3.088 | 2.9509 | 0.5131 |
| −2.5836 | 2.2429 | 0.5131 |
| −1.9173 | 1.8972 | 0.5131 |
| −1.4935 | 1.7717 | 0.5131 |
| −1.6006 | 1.7358 | 0.5131 |
| −1.6468 | 1.8788 | 0.5131 |
| −1.4987 | 1.7259 | 0.5131 |
| −2.0244 | 2.135 | 0.5131 |
| −4.2065 | 3.1636 | 0.5131 |
| −2.6519 | 2.5935 | 0.5131 |
| −3.1419 | 2.5411 | 0.5131 |
| −3.3887 | 3.2272 | 0.5131 |
| −2.2706 | 2.0791 | 0.5131 |
| −1.4947 | 1.7327 | 0.5131 |
| −1.7555 | 1.8148 | 0.5131 |
| −1.5326 | 1.8031 | 0.5131 |
| −1.5436 | 1.7069 | 0.5131 |
| −1.7658 | 1.9583 | 0.5131 |
| −2.2519 | 2.2956 | 0.5131 |
| −3.7655 | 2.8917 | 0.5131 |
| −2.9397 | 2.8244 | 0.5131 |
| −2.7606 | 2.3364 | 0.5131 |
| −3.6786 | 3.5278 | 0.5131 |
| −2.0195 | 1.9495 | 0.5131 |
| −1.4897 | 1.754 | 0.5131 |
| −1.6418 | 1.7568 | 0.5131 |
| −1.6008 | 1.8483 | 0.5131 |
| −1.5053 | 1.7177 | 0.5131 |
| −1.927 | 2.0678 | 0.5131 |
| −4.4266 | 3.3111 | 0.5131 |
| −2.5136 | 2.4879 | 0.5131 |
| −4.7367 | 7.2041 | 0 |
| −4.767 | 7.2481 | 0 |
| −4.8283 | 7.312 | 0 |
| −5.1022 | 7.3286 | 0 |
| −4.6814 | 7.1111 | 0 |
| −4.7572 | 7.2369 | 0 |
| −4.7824 | 7.2656 | 0 |
| −4.8996 | 7.3476 | 0 |
| −5.2847 | 7.2277 | 0 |
| −4.7209 | 7.1812 | 0 |
| −4.767 | 7.2481 | 0 |
| −4.8088 | 7.2946 | 0 |
| −5.0237 | 7.3515 | 0 |
| −4.6579 | 7.0621 | 0 |
| −5.4991 | 7.0497 | 0 |
| −4.7488 | 7.222 | 0 |
| −4.7736 | 7.2559 | 0 |
| −4.8578 | 7.3302 | 0 |
| −5.1888 | 7.2878 | 0 |
| −4.7027 | 7.1503 | 0 |
| −4.764 | 7.2447 | 0 |
| −4.7946 | 7.2781 | 0 |
| −4.9554 | 7.3568 | 0 |
| −4.6346 | 7.0018 | 0 |
| −5.3887 | 7.1484 | 0 |
| −5.9407 | 6.4384 | 0 |
| −4.6131 | 6.0299 | 0 |
| −4.59 | 6.7384 | 0 |
| −5.614 | 6.9304 | 0 |
| −6.0748 | 6.0158 | 0 |
| −4.5986 | 6.3488 | 0 |
| −4.6142 | 6.9284 | 0 |
| −5.8422 | 6.6228 | 0 |
| −4.6154 | 5.8589 | 0 |
| −4.5881 | 6.6221 | 0 |
| −6.0202 | 6.2356 | 0 |
| −4.6067 | 6.194 | 0 |
| −4.5991 | 6.8407 | 0 |
| −5.7299 | 6.7888 | 0 |

TABLE I-continued

| X Coordinate | Y Coordinate | Z Coordinate |
|---|---|---|
| −6.0992 | 5.7819 | 0 |
| −4.6112 | 5.6811 | 0 |
| −4.5914 | 6.4922 | 0 |
| −4.1704 | 4.1611 | 0 |
| −6.0445 | 5.2898 | 0 |
| −4.5406 | 5.1113 | 0 |
| −3.8173 | 3.6573 | 0 |
| −4.3557 | 4.5272 | 0 |
| −5.8563 | 4.8032 | 0 |
| −4.5987 | 5.4968 | 0 |
| −5.0423 | 3.7884 | 0 |
| −4.0617 | 3.987 | 0 |
| −6.0897 | 5.5382 | 0 |
| −4.4922 | 4.9142 | 0 |
| −4.2687 | 4.3413 | 0 |
| −5.9646 | 5.041 | 0 |
| −4.5758 | 5.3066 | 0 |
| −5.2308 | 3.9696 | 0 |
| −3.9436 | 3.8191 | 0 |
| −4.4304 | 4.7185 | 0 |
| −5.7247 | 4.5773 | 0 |
| −4.8449 | 3.6169 | 0 |
| −2.787 | 2.3292 | 0 |
| −3.5445 | 3.3508 | 0 |
| −2.0527 | 1.9463 | 0 |
| −1.5364 | 1.7439 | 0 |
| −1.6814 | 1.7578 | 0 |
| −1.6059 | 1.8258 | 0 |
| −1.5495 | 1.7233 | 0 |
| −1.8792 | 2.0079 | 0 |
| −4.4295 | 3.2993 | 0 |
| −2.4086 | 2.3806 | 0 |
| −3.3616 | 2.6409 | 0 |
| −3.1046 | 2.9336 | 0 |
| −2.4477 | 2.1503 | 0 |
| −1.8662 | 1.8516 | 0 |
| −1.5381 | 1.7749 | 0 |
| −1.61 | 1.7216 | 0 |
| −1.6885 | 1.8802 | 0 |
| −2.0596 | 2.1318 | 0 |
| −3.9936 | 3.0105 | 0 |
| −2.6761 | 2.5824 | 0 |
| −2.9714 | 2.4279 | 0 |
| −3.3998 | 3.2053 | 0 |
| −2.1691 | 2.0059 | 0 |
| −1.5396 | 1.7365 | 0 |
| −1.7318 | 1.7834 | 0 |
| −1.5762 | 1.806 | 0 |
| −1.5643 | 1.7144 | 0 |
| −1.8055 | 1.9582 | 0 |
| −4.6403 | 3.454 | 0 |
| −2.2831 | 2.2896 | 0 |
| −3.5667 | 2.7564 | 0 |
| −2.9589 | 2.8092 | 0 |
| −2.6098 | 2.2354 | 0 |
| −3.684 | 3.5013 | 0 |
| −1.9518 | 1.8949 | 0 |
| −1.5346 | 1.7574 | 0 |
| −1.641 | 1.7373 | 0 |
| −1.6433 | 1.8503 | 0 |
| −1.5413 | 1.7335 | 0 |
| −1.964 | 2.0657 | 0 |
| −4.2136 | 3.1518 | 0 |
| −2.5403 | 2.4786 | 0 |
| −3.1631 | 2.5317 | 0 |
| −3.2524 | 3.0658 | 0 |
| −2.3008 | 2.0738 | 0 |
| −1.5413 | 1.7335 | 0 |
| −1.7932 | 1.8146 | 0 |
| −1.5526 | 1.7914 | 0 |
| −1.5857 | 1.7123 | 0 |
| −1.7422 | 1.9159 | 0 |
| −2.1661 | 2.2062 | 0 |
| −3.7776 | 2.8793 | 0 |
| −2.8158 | 2.6925 | 0 |

It will also be appreciated that the airfoil disclosed in the above Table may be scaled up or down geometrically for use in other similar turbine designs. Consequently, the coordinate values set forth in Table I may be scaled upwardly or downwardly such that the airfoil section shape remains unchanged. A scaled version of the coordinates in Table I would be represented by X, Y and Z coordinate values multiplied or divided by the same constant or number.

Figure 4:
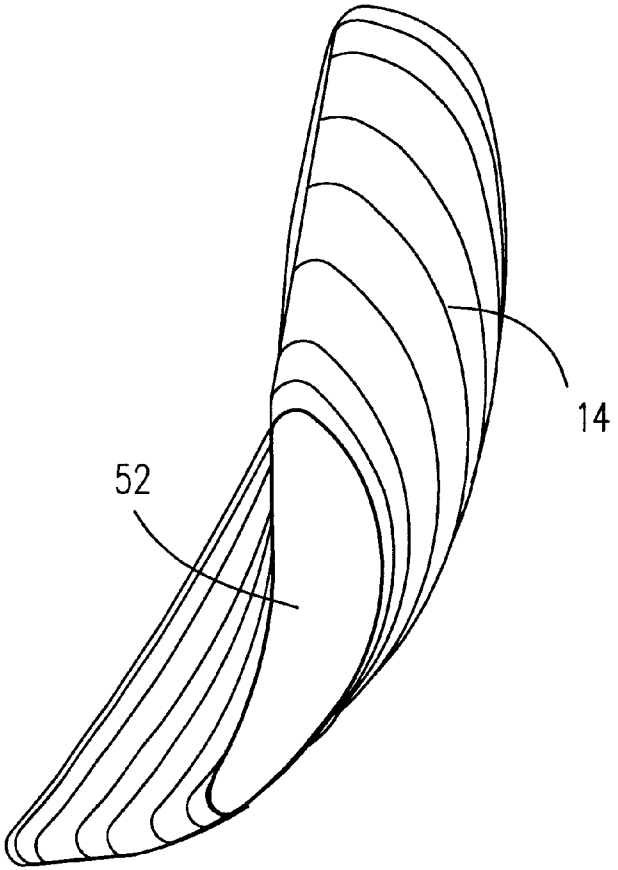
FIGS. 3 and 4 are end views from respective radially outer and inner portions of the nozzle vanes illustrated in FIG. 2.
Figure 3:
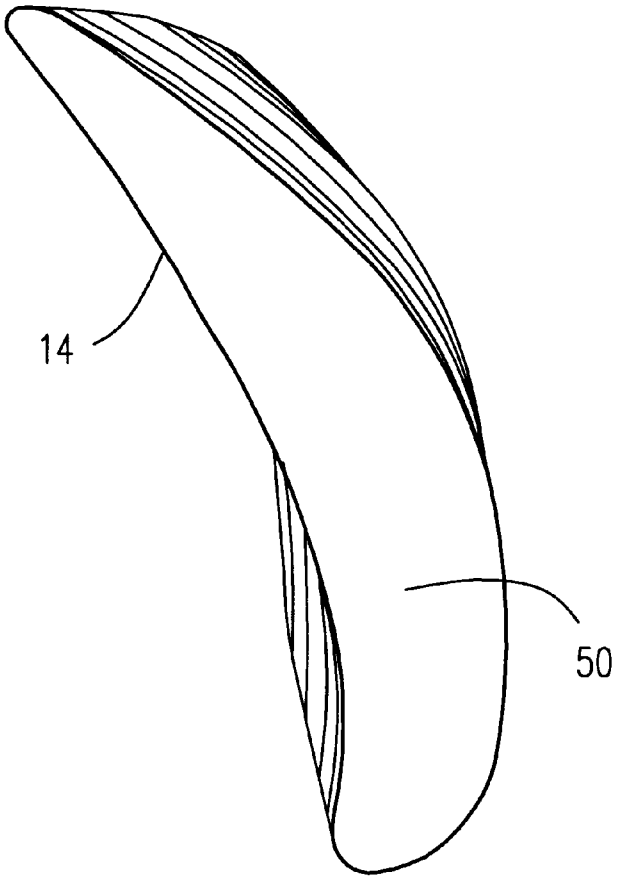
Figure 6:
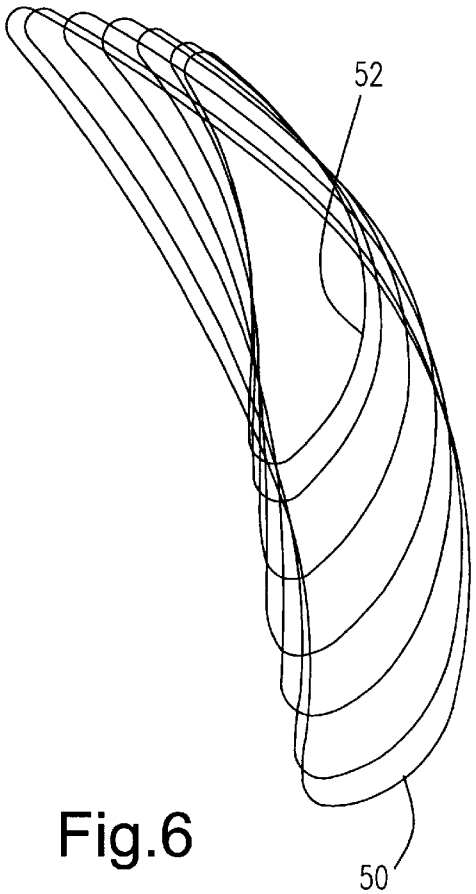
FIG. 6 is a view similar to FIG. 3 illustrating the profile sections at various radial locations along the vane.
Figure 5:
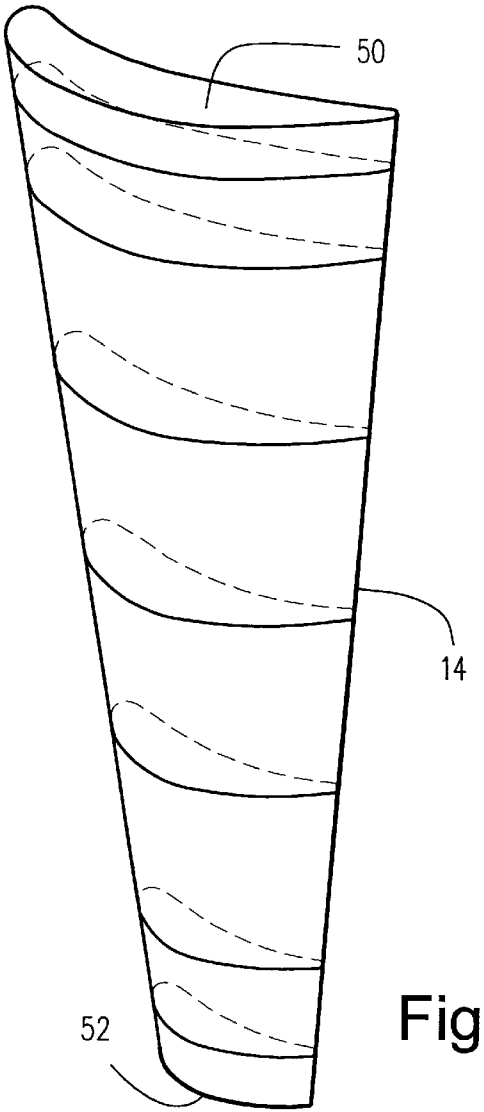
FIG. 5 is a perspective view of a nozzle vane illustrating various airfoil profiles along the length of the vane.

In FIGS. 3 and 4, the radially outermost and innermost profiles 50 and 52 are illustrated with various other profile sections also illustrated along the length of the airfoil. The various profiles are also illustrated in the perspective view of FIG. 5 with the profiles being superposed one over the other in FIG. 6.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine nozzle having a nozzle vane in the shape of an airfoil in an envelope within ±0.100 inches in a direction normal to any airfoil surface location wherein the airfoil has an uncoated nominal profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinate values defining the airfoil profile at each distance Z, the profiles at the Z distances being joined smoothly with one another to form the complete airfoil shape.

2. A turbine nozzle according to claim 1 forming part of a third stage of a turbine.

3. A turbine nozzle having a nozzle vane in the shape of an airfoil having an uncoated nominal airfoil profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinate values defining the airfoil profile at each distance Z, the profiles at the Z distances being joined smoothly with one another to form the complete airfoil profile;

the X, Y and Z values being scaled as a function of the same constant or number to provide a scaled-up or scaled-down nozzle airfoil.

4. A turbine nozzle according to claim 3 forming part of a third stage of a turbine.

5. A turbine comprising a turbine nozzle having a plurality of vanes, each of said vanes being in the shape of an airfoil in an envelope within ±0.100 inches in a direction normal to any nozzle airfoil surface location wherein the airfoil has an uncoated nominal profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinate values defining the airfoil profile at each distance Z, the profiles at the Z distances being joined smoothly with one another to form the complete airfoil shape.

6. A turbine according to claim 5 wherein the turbine nozzle comprises a third stage of the turbine.

7. A turbine according to claim 5 wherein the turbine nozzle has sixty vanes and X represents a distance parallel to a rotary axis of the turbine.

8. A turbine comprising a turbine nozzle having a plurality of vanes, each of said vanes being in the shape of an airfoil having an uncoated nominal airfoil profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at the radially innermost aerodynamic section of the airfoil and X and Y are coordinate values defining the airfoil profile at each distance Z, the profiles at the Z distances being joined smoothly with one another to form the complete airfoil shape;

the X, Y and Z values being scaled as a function of the same constant or number to provide a scaled-up or scaled-down nozzle airfoil.

9. A turbine according to claim 8 wherein the turbine nozzle comprises a third stage of the turbine.

10. A turbine according to claim 8 wherein the turbine nozzle has sixty vanes and X represents a distance parallel to a rotary axis of the turbine.

* * * * *

UNITED STATES PATENT AND TRADEMARK OFFICE

CERTIFICATE OF CORRECTION

PATENT NO. : 6,461,109 B1
DATED : October 8, 2002
INVENTOR(S) : Wedlake et al.

It is certified that error appears in the above-identified patent and that said Letters Patent is hereby corrected as shown below:

Column 4,
Line 34, in the 3rd column of Table 1 (Z Coordinate) kindly delete “15.1342” and insert -- 18.1342 -- therefor.
Line 51, in the 3rd column of Table 1 (Z Coordinate) kindly delete “13.1342” and insert -- 18.1342 -- therefor.

Column 6,
Line 19, in the 1st column of Table 1 (X Coordinate) kindly delete “-4.5835” and insert -- -4.8835 -- therefor.

Column 9,
Line 19, in the 3rd column of Table 1 (Z Coordinate) kindly delete “14.4997” and insert -- 14.1997 -- therefor.

Column 10,
Line 61, in the 1st column of Table 1 (X Coordinate) kindly delete “-3.8234” and insert -- -3.8284 -- therefor.

Column 11,
Line 20, in the 3rd column of Table 1 (Z Coordinate) kindly delete “12.4385” and insert -- 12.4885 -- therefor.

Column 17,
Line 52, in the 1st column of Table 1 (X Coordinate) kindly delete “-3.6387” and insert -- -3.6287-- therefor.

UNITED STATES PATENT AND TRADEMARK OFFICE

CERTIFICATE OF CORRECTION

PATENT NO. : 6,461,109 B1
DATED : October 8, 2002
INVENTOR(S) : Wedlake et al.

It is certified that error appears in the above-identified patent and that said Letters Patent is hereby corrected as shown below:

Column 21,
Line 62, in the 2nd column of Table 1 (Y Coordinate) kindly delete "2.0756" and insert -- 2.7056 -- therefor.

Signed and Sealed this

Eighth Day of April, 2003

JAMES E. ROGAN
*Director of the United States Patent and Trademark Office*